US011511305B2

(12) United States Patent
Masse

(10) Patent No.: US 11,511,305 B2
(45) Date of Patent: Nov. 29, 2022

(54) ADAPTER FOR SELECTIVELY CONNECTING AN ACCESSORY TO A SPRAY GUN

(71) Applicant: LES ENTREPRISES FRANCOIS MASSE INC., Trois-Rivieres (CA)

(72) Inventor: Jean-Francois Masse, Trois-Rivieres (CA)

(73) Assignee: LES ENTREPRISES FRANCOIS MASSE INC., Trois-Rivieres (CA)

( * ) Notice: Subject to any disclaimer, the term of this patent is extended or adjusted under 35 U.S.C. 154(b) by 0 days.

(21) Appl. No.: 17/045,789

(22) PCT Filed: Apr. 9, 2019

(86) PCT No.: PCT/CA2019/050426

§ 371 (c)(1),
(2) Date: Oct. 7, 2020

(87) PCT Pub. No.: WO2019/195927

PCT Pub. Date: Oct. 17, 2019

(65) Prior Publication Data

US 2021/0154694 A1 May 27, 2021

Related U.S. Application Data

(60) Provisional application No. 62/656,442, filed on Apr. 12, 2018.

(51) Int. Cl.
*B05B 15/656* (2018.01)
*B05B 15/16* (2018.01)
*B05B 15/65* (2018.01)

(52) U.S. Cl.
CPC ..... *B05B 15/656* (2018.02); *B05B 15/16* (2018.02); *B05B 15/65* (2018.02)

(58) Field of Classification Search
CPC ..... B05B 15/656; B05B 15/65; B05B 15/16
(Continued)

(56) References Cited

U.S. PATENT DOCUMENTS 3,700,174 A 10/1972 Beck
3,952,955 A 4/1976 Clements
(Continued)

FOREIGN PATENT DOCUMENTS

AU 875666 A 1/1968
CN 1325761 A 12/2001
(Continued)

OTHER PUBLICATIONS

English translation of CN207188095U retrieved from https://patents.google.com/patent/CN207188095U/en?oq=cn207188095 on Sep. 27, 2021.

(Continued)

*Primary Examiner* — Christopher S Kim
(74) *Attorney, Agent, or Firm* — BCF LLP

(57) ABSTRACT

An adapter for selectively connecting an accessory to a spray gun has an upstream connector for connecting to the spray gun, a downstream connector for connecting to accessory, a gasket located between the upstream and downstream connectors, and the upstream and downstream connectors are selectively connected together. When connected, one of the upstream and downstream connectors has a cylindrical portion at least partially inserted into another one of the upstream and downstream connectors, and a post projecting radially from the cylindrical portion. The other one of the upstream and downstream connectors has an arcuate slot being shaped and structured to receive the post of the one of the upstream and downstream connectors. A spray gun assembly has spray gun, an accessory and at least one adapter connecting the spray gun and the accessory together.

16 Claims, 22 Drawing Sheets

(58) Field of Classification Search
USPC ..... 239/397, 442, 600
See application file for complete search history.

(56) References Cited

U.S. PATENT DOCUMENTS

| | | | | |
|---|---|---|---|---|
| 4,437,610 | A | 3/1984 | Huber et al. | |
| 4,738,401 | A | 4/1988 | Filicicchia | |
| 5,271,564 | A | 12/1993 | Smith | |
| 5,379,938 | A | 1/1995 | Perret, Jr. | |
| 5,609,302 | A | 3/1997 | Smith | |
| 6,244,527 | B1 | 6/2001 | Ferrazza et al. | |
| 6,398,128 | B1 | 6/2002 | Hamilton et al. | |
| 6,398,136 | B1 * | 6/2002 | Smith | A62C 31/22 239/600 |
| 7,540,434 | B2 | 6/2009 | Gohring et al. | |
| 7,677,476 | B2 | 3/2010 | Burdsall et al. | |
| 8,419,468 | B2 | 4/2013 | Alrutz et al. | |
| 8,939,387 | B2 | 1/2015 | Fontaine | |
| 9,808,816 | B1 | 11/2017 | Enriquez | |
| 2009/0302133 | A1 | 12/2009 | Micheli et al. | |
| 2011/0240763 | A1 | 10/2011 | Svendsen et al. | |
| 2016/0114347 | A1 | 4/2016 | Kosarnig | |

FOREIGN PATENT DOCUMENTS

| | | | |
|---|---|---|---|
| CN | 201293170 | Y | 8/2009 |
| CN | 207188095 | U | 4/2018 |
| DE | 3046464 | A1 | 7/1982 |
| JP | 2009123591 | A | 6/2009 |
| WO | 2016205801 | A1 | 12/2016 |

OTHER PUBLICATIONS

Office Action issued by the Chinese Patent Office dated Sep. 10, 2021 in connection with the corresponding application No. 201980033079.9.

English translation of JP2009123591A retrieved from https://patents.google.com/patent/JP2009123591A/en?oq=jp2009123591 on Sep. 29, 2021.

English translation of CN201293170Y retrieved from https://patents.google.com/patent/CN201293170Y/en?oq=CN201293170 on Sep. 29, 2021.

The Supplementary European Search Report issued by the European Patent Office dated Oct. 4, 2021 in connection with the corresponding application No. 19786165.1.

International Search Report of PCT/CA2019/050426; S. Tupper; dated Jun. 18, 2019.

picgrace.com; Quick Connect; Jan. 2019; retrieved from http://picgrace.com/post/46442206A64442A1689_8266149393 on Jun. 21, 2019.

Office Action issued from the EPO dated Jun. 7, 2022 in connection with the corresponding Application No. 19786165.1.

* cited by examiner

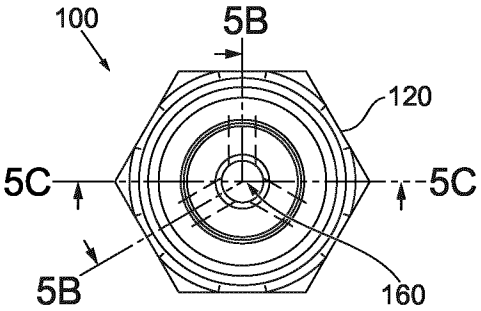
FIG. 5A
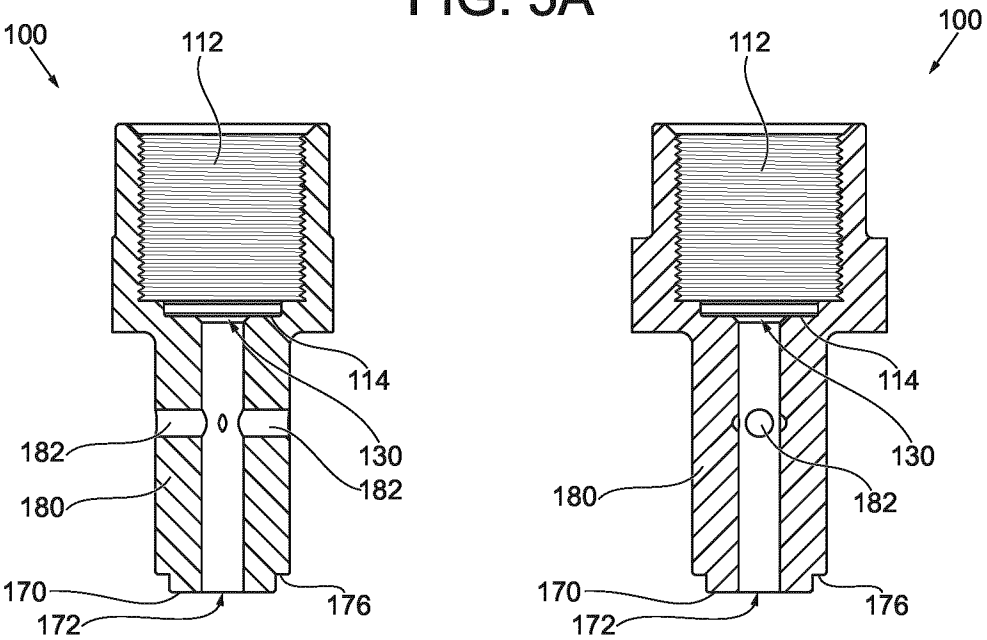
FIG. 5C
FIG. 5B

ADAPTER FOR SELECTIVELY CONNECTING AN ACCESSORY TO A SPRAY GUN

CROSS-REFERENCE TO RELATED APPLICATION

The present application claims priority to U.S. Provisional Patent Application Ser. No. 62/656,442, filed Apr. 12, 2018, entitled "Adapter For Selectively Connecting An Accessory Assembly to A Paint Sprayer", which is incorporated by reference herein in its entirety.

FIELD OF TECHNOLOGY

The present technology relates to an adapter for selectively connecting an accessory to a spray gun.

BACKGROUND

Spray guns are commonly used in various environments for spraying a medium onto a surface. One particular type of spray gun is a paint sprayer. When using a paint sprayer, it is common practice to connect an accessory, such as a tip guard or an extension tube, to the spray nozzle of the paint sprayer, depending on the paint job to perform. Generally, the accessory is connected to the spray nozzle via a threaded connection. As the paint jobs on a job site differ, a user may need to swap between different accessories depending on the paint job to perform. For example, a user may use the paint sprayer without an extension tube when painting a surface located in close quarters, i.e. when painting in a closet, and may use an extension tube when painting a surface that is hard to reach, i.e. when painting a ceiling.

However, as the accessory gets used, connected to and disconnected from the spray nozzle, dry paint may form a crust in the threads of the spray nozzle and/or of the accessory. As a result, when the user connects the accessory back on to the spray nozzle, the crust of dry paint may, under some conditions, render the connection therebetween defective and cause a pressure loss in the stream of paint. This can lead to reduced performances and/or undesirable leaks between the spray nozzle and the accessory. Moreover, since the user may swap between different accessories, such as extension tubes of different lengths in one paint session, connecting the accessory to the spray nozzle via a threaded connection is tedious and time consuming.

Therefore, there is still a desire for a way of connecting an accessory, such as an extension tube and/or a tip guard, to the spray nozzle of a spray gun that addresses at least some of the inconveniences listed above.

SUMMARY

It is an object of the present technology to ameliorate at least some of the inconveniences present in the prior art.

According to an aspect of the present technology, there is provided an adapter for selectively connecting an accessory to a spray gun having a spray nozzle. The adapter enables, under some conditions, a sealed connection between the spray nozzle and the accessory without using a threaded connection, as it is known in the art. In addition, the adapter of the present technology reduces time required for connection and disconnection of an accessory to and from a spray nozzle of a spray gun compared to a conventional threaded connection, which may be beneficial to a user who desires to swap between different accessories. Moreover, the adapter of the present technology does not include any moving parts that could become inoperative should they be exposed to the medium being sprayed (for example, paint), and seize in place. Furthermore, the adapter of the present technology can be cleaned more easily than a spray nozzle and/or an accessory that are structured to be connected together via a threaded connection.

In accordance with an aspect of the present technology, there is provided an adapter for selectively connecting an accessory to a spray gun having a spray nozzle. The adapter has an upstream connector for selectively connecting to the spray nozzle of the spray gun. The upstream connector has an upstream body including an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice. The adapter further has a downstream connector being selectively connected to the upstream connector. The downstream connector has a downstream body including an upstream portion defining an upstream orifice, and a second seat facing the upstream connector and surrounding the upstream orifice, a downstream portion for connecting to the accessory, and the downstream body defining an internal bore fluidly connected to the internal bore of the upstream connector. The adapter further has a gasket located between the first and second seats. The gasket is resiliently compressed between the first and second seats to form a seal between the upstream connector and the downstream connector. One of the upstream and downstream connectors has a cylindrical portion at least partially inserted into another one of the upstream and downstream connectors, and at least one post projecting radially from the cylindrical portion. The other one of the upstream and downstream connectors has at least one arcuate slot defined therein. The at least one arcuate slot is shaped and structured to receive the at least one post of the one of the upstream and downstream connectors.

In some implementations, to connect disconnected upstream and downstream connectors, the cylindrical portion is simultaneously axially inserted and twisted into the other one of the upstream and downstream connectors, and cooperative engagement of the at least one post in the at least one arcuate slot draws together the upstream and downstream connectors, causing the first seat to be axially drawn toward the second seat, resiliently compressing the gasket therebetween and connecting the upstream connector to the downstream connector.

In some implementations, to disconnect connected upstream and downstream connectors, the upstream connector is twisted relative to the downstream connector, and cooperative engagement of the at least one post in the at least one arcuate slot pushes apart the upstream and downstream connectors, causing the first seat to be axially drawn away from the second seat, resiliently relaxing the gasket and disconnecting the upstream connector from the downstream connector.

In some implementations, the downstream body further has a cylindrical base. The at least one arcuate slot is defined in the base of the downstream body. The at least one arcuate slot has an open end defined at the base of the downstream body and a closed end, a first section extending from the open end and being skewed with respect to the base, a second section extending from the first section toward the closed end, the second section extending generally circumferentially relative to the base, a third section extending between the second section and the closed end, the third section extending from the second section toward the base, and the at least one post is in a selectively locked engagement in the at least one arcuate slot when received in the third section of the at least one arcuate slot. In some conditions, the cooperative engagement of the at least one post in the at least one arcuate slot renders the upstream and downstream connectors connectable and disconnectable even if dry, crusted paint is present on either one of the upstream and downstream connectors. For example, in some conditions, even if dry paint accumulates between the seats and/or the gasket, the shape of the at least one arcuate slot permits convenient connection and disconnection of the upstream and downstream connectors.

In some implementations, the downstream body defines a groove. The groove is adjacent the second seat. The gasket is removably retained in the groove. In some conditions, having the gasket removably retained in the groove may prevent it from falling off, while permitting access thereto for cleaning and/or replacement.

In some implementations, the wherein the internal bores of the upstream and downstream bodies are coaxial. This feature may limit the pressure loss between the spray nozzle and the accessory.

In some implementations, the internal bores of the upstream and downstream bodies have a same diameter.

In some implementations, the upstream connector has a thread for connecting to the spray nozzle. This feature permits that the upstream connector be connected to the spray nozzle via a standard threaded connection, so no modification to a standard spray nozzle is required to use the adapter of the present technology.

In some implementations, the downstream connector has a thread for connecting to the accessory. This feature permits that the downstream connector be connected to the accessory via a standard threaded connection, so no modification to a standard accessory is required to use the adapter of the present technology.

In some implementations, the at least one post is three posts. The one of the upstream and downstream connectors having the cylindrical portion has the three posts projecting radially from the cylindrical portion, adjacent posts being angularly spaced from one another by an angular spacing. The at least one arcuate slot is three arcuate slots. The other one of the upstream and downstream connectors has the three arcuate slots defined in the body thereof, adjacent arcuate slots being angularly spaced from one another by the angular spacing.

In some implementations, the angular spacing is of 120 degrees.

In some implementations, each of the upstream and downstream bodies includes a hexagonal outer surface. This feature may facilitate manipulation of the upstream and downstream connectors for selectively connecting them together, or selectively disconnecting them from one another. This feature may also facilitate manipulation of the upstream connector when connected to the spray nozzle, and of the downstream connector when connected to the accessory.

In some implementations, the at least one post is integral with the one of the upstream and downstream connectors having the cylindrical portion.

In accordance with another aspect, there is provided a spray gun assembly including a spray gun, at least one accessory, and at least one adapter as described above connecting the spray gun and the at least one accessory together.

In some implementations, the spray gun is one of an airless paint sprayer and an air-assisted paint sprayer.

In some implementations, the at least one accessory includes a first accessory having first and second end portions. The at least one adapter is a first adapter and a second adapter. The first adapter connects the spray gun to the first end portion of the first accessory, and the second adapter is connected to the second end portion of the first accessory.

In some implementations, the at least one accessory further includes a second accessory, and the second adapter connects the second end portion of the first accessory to the second accessory.

In some implementations, the spray gun assembly further includes a cap disposed between one of the first and second accessories and one of the first and second adapters.

Moreover, the present technology provides for a connector that can be connected to a spray gun and/or and accessory for a spray gun, and that could facilitate connection and disconnection between the spray gun and the accessory. It is contemplated that the spray gun could have the upstream connector of the adapter of the present technology connected thereto, and the accessory could have the downstream connector of the adapter of the present technology connected thereto (or vice-versa), and selective connection of the upstream and downstream connectors could connect the spray gun to the accessory. It is also contemplated that upstream connector could be integral with the spray gun, and the downstream connector could be integral with the accessory.

In accordance with yet another aspect of the present technology, there is provided a connector adapted for connection to one of a spray gun and an accessory. The connector includes a body having cylindrical base, and at least one arcuate slot defined in the base of the body. The at least one arcuate slot has an open end defined at the base of the body and a closed end, a first section extending from the open end and being skewed with respect to the base, a second section extending from the first section toward the closed end, the second section extending generally circumferentially relative to the base, and a third section extending between the second section and the closed end, the third section extending from the second section toward the base.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying figures and the appended claims.

BRIEF DESCRIPTION OF THE FIGURES

For a better understanding of the present technology, as well as other aspects and further features thereof, reference is made to the following description which is to be used in conjunction with the accompanying figures, where:

FIG. 5A is a rear elevation view of an upstream connector of the adapter of FIG. 1;

FIG. 5B is a cross-sectional view of the upstream connector of FIG. 5A taken along cross-section line 5B-5B of FIG. 5A;

FIG. 5C is a cross-sectional view of the upstream connector of FIG. 5A taken along cross-section line 5C-5C of FIG. 5A;

DETAILED DESCRIPTION

Figure 1:
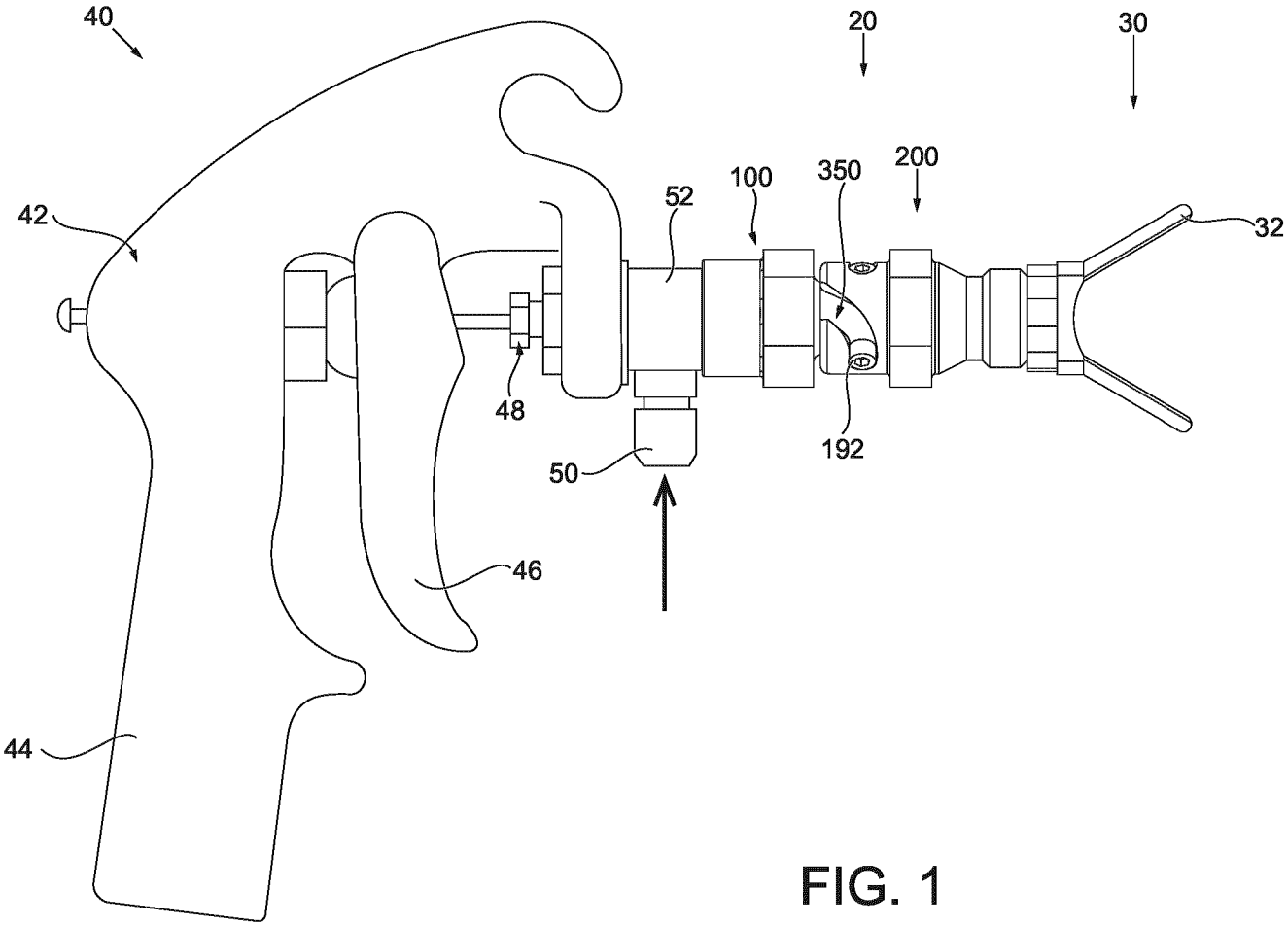
FIG. 1 is a right side elevation view of a spray gun with an adapter in accordance with a first implementation of the present technology, the adapter selectively connecting the spray gun to a tip guard.

Referring to FIGS. 1 to 11, a first implementation of an adapter 20 for selectively connecting an accessory 30 to a spray gun 40 will be described. A second implementation of an adapter 1020 for selectively connecting an accessory 1030 to a spray gun 1040 will be described with reference to FIGS. 12 to 22. The spray guns 40, 1040 presented herein are paint sprayers, are merely an example for aiding in understanding the present technology. It is contemplated that the spray guns 40, 1040 could be adapted to spray a medium other than paint.

Furthermore, it is to be expressly understood that the adapters 20, 1020 are merely implementations of the present technology. Thus, the description thereof that follows is intended to be only a description of illustrative examples of the present technology. This description is not intended to define the scope or set forth the bounds of the present technology. In some cases, what are believed to be helpful examples of modifications or alternatives to the adapters 20, 1020 may also be set forth below. This is done merely as an aid to understanding, and, again, not to define the scope or set forth the bounds of the present technology. These modifications are not an exhaustive list, and, as a person skilled in the art would understand, other modifications are likely possible. Further, where this has not been done (i.e. where no examples of modifications have been set forth), it should not be interpreted that no modifications are possible and/or that what is described is the sole manner of implementing or embodying that element of the present technology. As a person skilled in the art would understand, this is likely not the case. In addition, it is to be understood that the adapters 20, 1020 may provide in certain aspects a simple implementation of the present technology, and that where such is the case it has been presented in this manner as an aid to understanding. As persons skilled in the art would understand, various implementations of the present technology may be of a greater complexity than what is described herein.

Referring now to FIGS. 1 to 11, before describing the adapter 20 in detail, the accessory 30 and the spray gun 40 will be briefly described. Turning to FIG. 1, the spray gun 40 is connectable to a paint supply source (schematically shown as an arrow) from which paint is supplied under high pressure. It is contemplated that the paint supply source supplies paint at a pressure ranging from about 800 to 4000 Psi (or from about 54 atm to 272 atm). In FIG. 1, the spray gun 40 is an airless paint sprayer, but other types of spray guns are contemplated, and as mentioned above are not limited to spray guns for paint. For example, in another implementation, the spray gun 40 is an air-assisted paint sprayer. In the present implementation, the paint supply source is adapted to the type of the spray gun 40. In FIGS. 1 to 11, the accessory 30 includes a tip guard 32.

The spray gun 40 has a body 42 forming a handle 44 by which the spray gun 40 may be held in the hand of a user for manipulation with reference to a surface which is being painted. A lever 46 is pivotally connected to the body 42.

The lever 46 actuates a valve assembly 48 of the spray gun 40. The body 42 further includes an inlet port 50 adapted for connection to the paint supply source.

Figure 2:
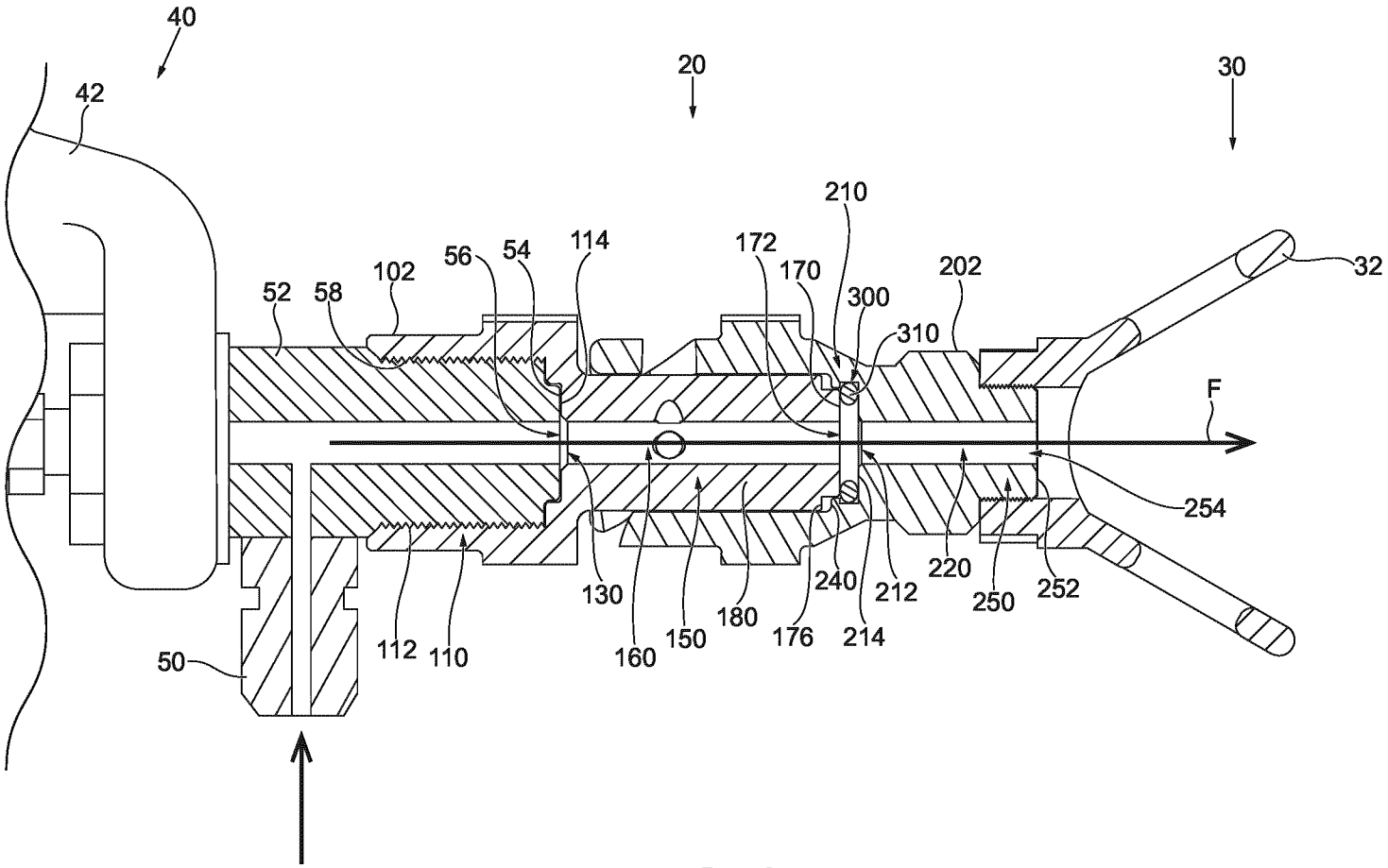
FIG. 2 is a longitudinal cross-sectional view of the adapter, the tip guard and a spray nozzle of the spray gun of FIG. 1.

Referring to FIGS. 1 and 2, a spray nozzle 52 is connected to the body 42 and is fluidly connected to the inlet port 50. The spray nozzle 52 has a front face 54 defining a spray orifice 56, and outer threads 58 permitting threaded connection to a variety of accessories. Upon actuation of the lever 46, the valve assembly 48 is moved in an open position, and paint under pressure flows from the paint supply source through the inlet port 50 into the spray nozzle 52 and through the spray orifice 56 to exit therefrom in the form of a fine spray.

Figure 3:
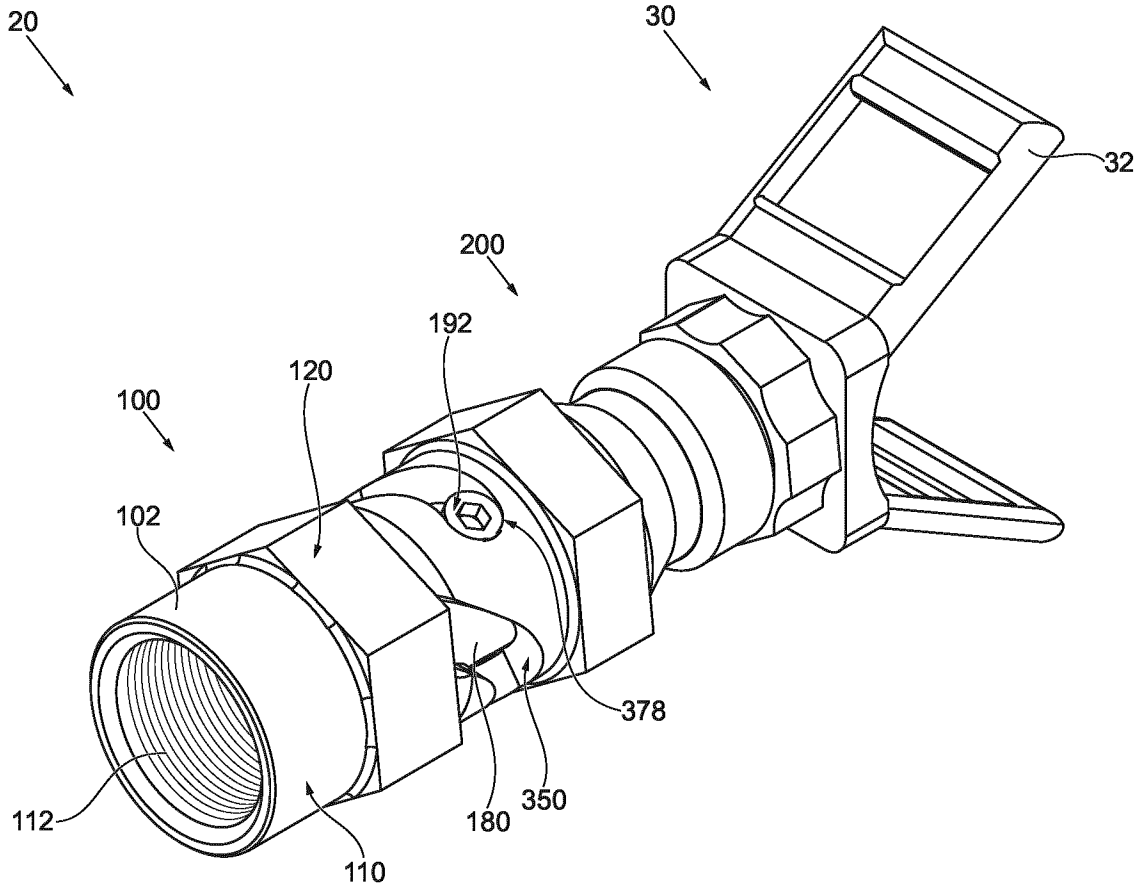
FIG. 3 is a perspective view taken from a top, right, rear side of the adapter and tip guard of FIG. 1.
Figure 4:
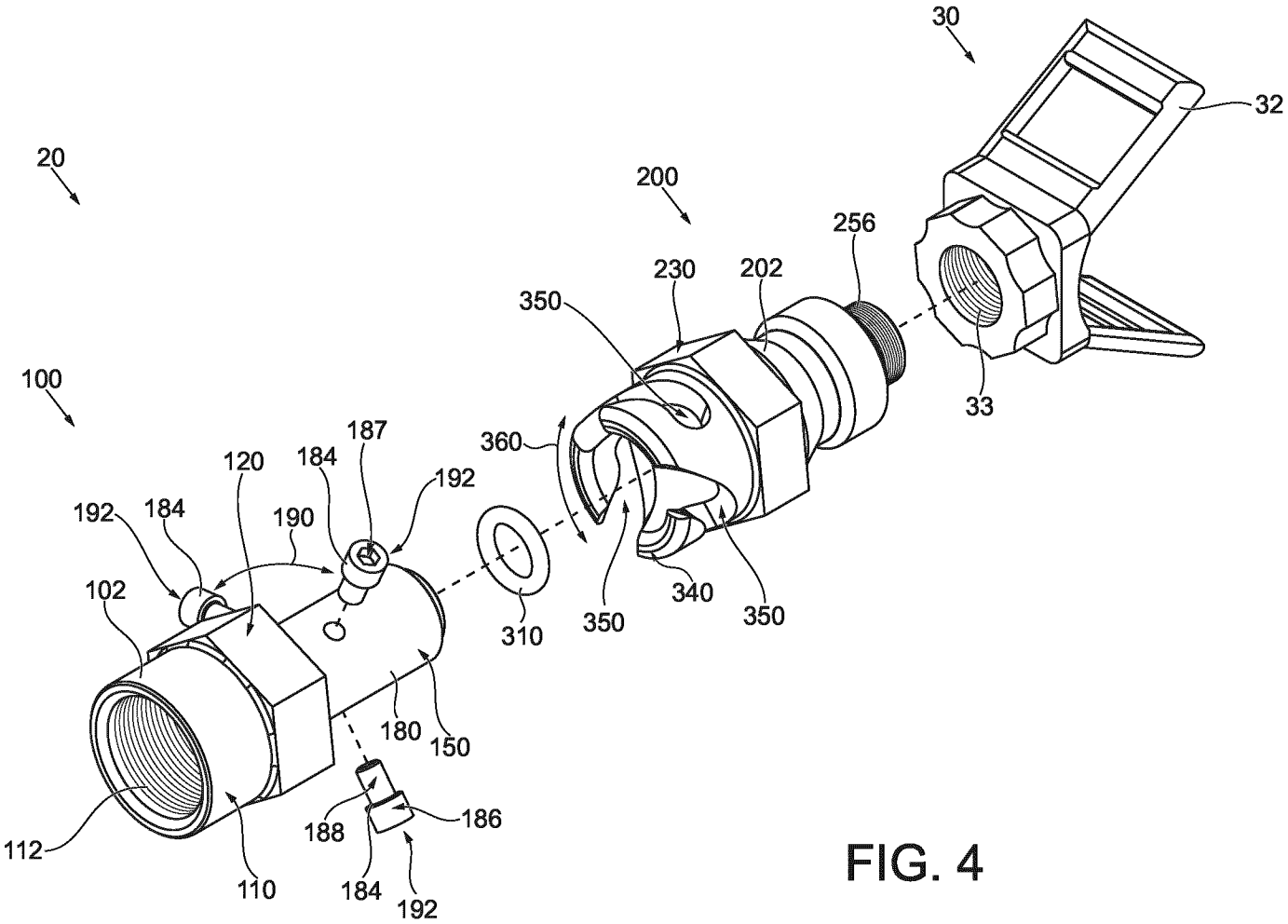
FIG. 4 is a perspective, exploded view taken from a top, right, rear side of the adapter and tip guard of FIG. 3.

Referring to FIGS. 2 to 4, the adapter 20 has an upstream connector 100 and a downstream connector 200. In the following description, the terms "upstream" and "downstream" are used as relative terms with respect to a flow F (schematically shown as an arrow in FIG. 2) of paint from the spray gun 40, through the adapter 20, and on to the accessory 30. Generally described, the upstream connector 100 is selectively connected to the spray nozzle 52, and the downstream connector 200 is selectively connected to the accessory 30. When the upstream and downstream connectors 100, 200 are selectively connected together, the adapter 20 fluidly connects the spray gun 40 to the accessory 30.

Referring now to FIGS. 1 to 5C, the upstream connector 100 will be described in more detail. The upstream connector 100 has an upstream body 102 that includes an upstream portion 110 for connecting to the spray nozzle 52, and a downstream portion 150 for connecting to the downstream connector 200. The upstream portion 110 has inner threads 112 that are complementary to the outer threads 58 of the spray nozzle 52. The upstream body 102 also includes a hexagonal outer surface 120. The outer surface 120 is structured and dimensioned to be manipulated by a hand and engaged by a tool, such as a wrench, to facilitate tightening or loosening of the threaded connection between the upstream connector 100 and the spray nozzle 52 of the spray gun 40. The upstream portion 110 also defines a seat 114 (FIG. 2) on which the front face 54 of the spray nozzle 52 abuts. The seat 114 surrounds an upstream orifice 130 of the upstream connector 100. The upstream orifice 130 is coaxial with the spray orifice 56 of the spray nozzle 52.

As best seen in FIGS. 2, 5B and 5C, the downstream portion 150 of the upstream body 102 defines, together with the upstream portion 110, an internal bore 160 extending through the upstream and downstream portions 110, 150. At the downstream end of the downstream portion 150, a seat 170 faces opposite the upstream portion 110, and defines a downstream orifice 172. The seat 170 surrounds the downstream orifice 172. As best seen in FIG. 2, the internal bore 160 is coaxial with the spray orifice 56, the upstream orifice 130 and the downstream orifice 172. As such, the spray nozzle 52 is fluidly connected to the downstream orifice 172 via the internal bore 160. The downstream portion 150 of the upstream body 102 further defines a shoulder 176 located upstream of the seat 170. The shoulder 176 is structured and dimensioned to limit the insertion of the downstream portion 150 into the downstream connector 200 as will be described in more detail below.

Referring to FIGS. 2 to 5C, the upstream body 102 of the upstream connector 100 further has a cylindrical portion 180 which is defined in the downstream portion 150 of the upstream body 102. The cylindrical portion 180 is selectively inserted into the downstream connector 200. As best seen in FIGS. 5B and 5C, three radially-extending threaded holes 182 (note: threads are not shown in the Figures) are defined in the cylindrical portion 180. As seen in FIG. 4, three screws 184 extend in the holes 182. The screws 184 are socket head cap screws. The screws 184 are threadedly connected to the cylindrical portion 180. As best seen in FIG. 4, each screw 184 has a head 186 and a threaded shank 188 (thread is not shown in the Figures). The head 186 of each screw 184 projects radially from the cylindrical portion 180. Each head 186 has a socket 187 which is engageable by a hexagonal key for screwing or unscrewing the screw 184. The shank 188 of each screw 184 extends in the corresponding threaded hole 182 and engages the thread defined therein, but does not extend in the internal bore 160 so as to not obstruct the flow of paint therein. Adjacent screws 184 are angularly displaced from one another by an angular spacing 190 of 120 degrees. In some implementations, the angular spacing 190 could differ between pairs of adjacent screws 184. The heads 186 of the screws 184 define three posts 192 projecting radially from the cylindrical portion 180. In another implementation, the screws 184 are omitted and the posts 192 are integrally formed with the upstream body 102 of the upstream connector 100, as will be described with reference to FIG. 15. It is also contemplated that, in other implementations, the upstream connector 100 could include less than three posts 192, or more than three posts 192. In some implementations, the screws 184 could be replaced by pins having threads similar to those of the shanks 188 that would also define posts 192, or by dowels press-fit into holes 182 that are free of threads.

Still referring to FIGS. 1 to 4, the downstream connector 200 will now be described in more detail. The downstream connector 200 has a downstream body 202 that includes an upstream portion 210 for connecting to the upstream connector 100, and a downstream portion 250 selectively connected to the accessory 30. More particularly, in the present implementation, the upstream portion 210 is adapted for receiving the cylindrical portion 180 of the upstream connector 100. Referring to FIG. 2, the upstream portion 210 defines an upstream orifice 212, and a seat 214 facing the upstream connector 100 and surrounding the upstream orifice 212. The upstream orifice 212 is coaxial with the downstream orifice 172 of the upstream connector 100. An internal bore 220 is defined in the downstream body 202 of the downstream connector 200 and is fluidly connected to the internal bore 160 of the upstream connector 100 via the upstream orifice 212. At the downstream end of the downstream body 202 of the downstream connector 200, a downstream face 252 facing opposite the upstream connector 100 defines a downstream orifice 254. The internal bore 220 extends through the upstream and downstream portions 210, 250 for fluidly connecting the upstream orifice 212 to the accessory 30 via the downstream orifice 254. As best seen in FIG. 2, the internal bores 160, 220 of the upstream and downstream connectors 100, 200 are coaxial and similarly sized, i.e. they have a same diameter. It is contemplated that the diameter of the internal bores 160, 220 is between 4 and 6 mm, but other sizes are contemplated.

Figure 6A:
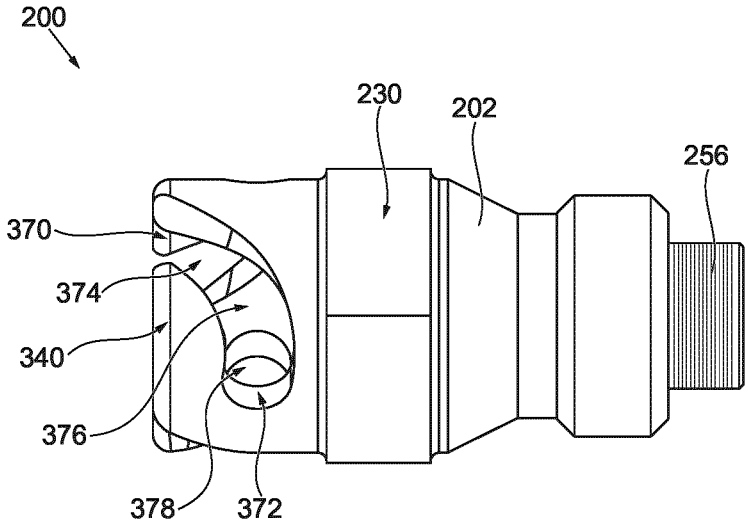
FIG. 6A is a right side elevation view of a downstream connector of the adapter of FIG. 1.
Figure 6B:
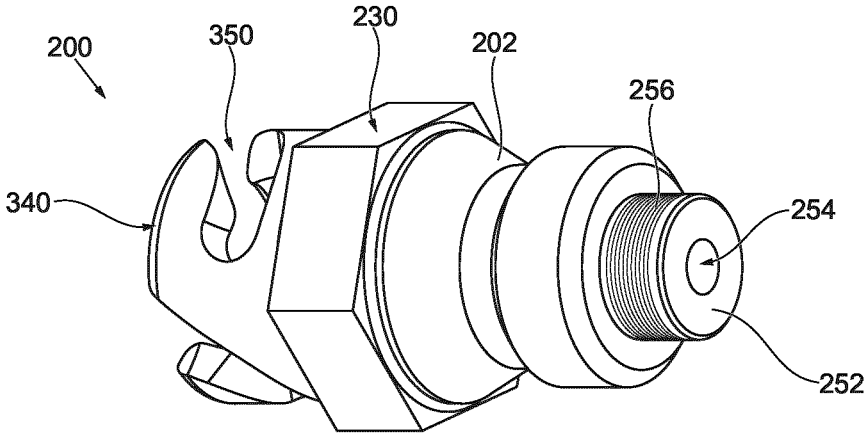
FIG. 6B is a perspective view taken from a front, right side of the downstream connector of FIG. 6A.
Figure 7:
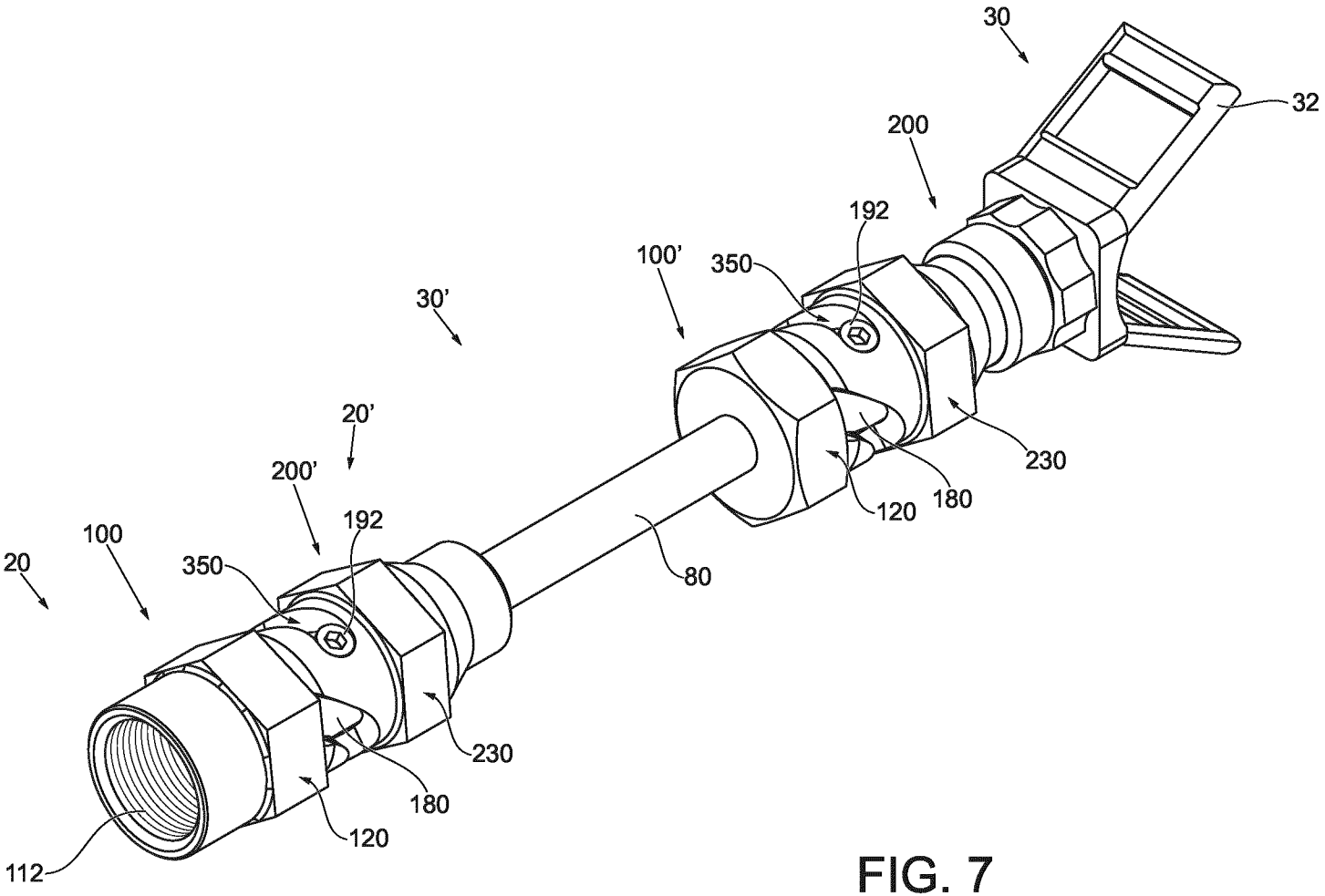
FIG. 7 is a perspective view taken from a top, right, rear side of the adapter of FIG. 1, with an extension tube assembly selectively connected thereto, the extension tube assembly including a second adapter, and the tip guard of FIG. 1 selectively connected to the extension tube assembly.
Figure 8:
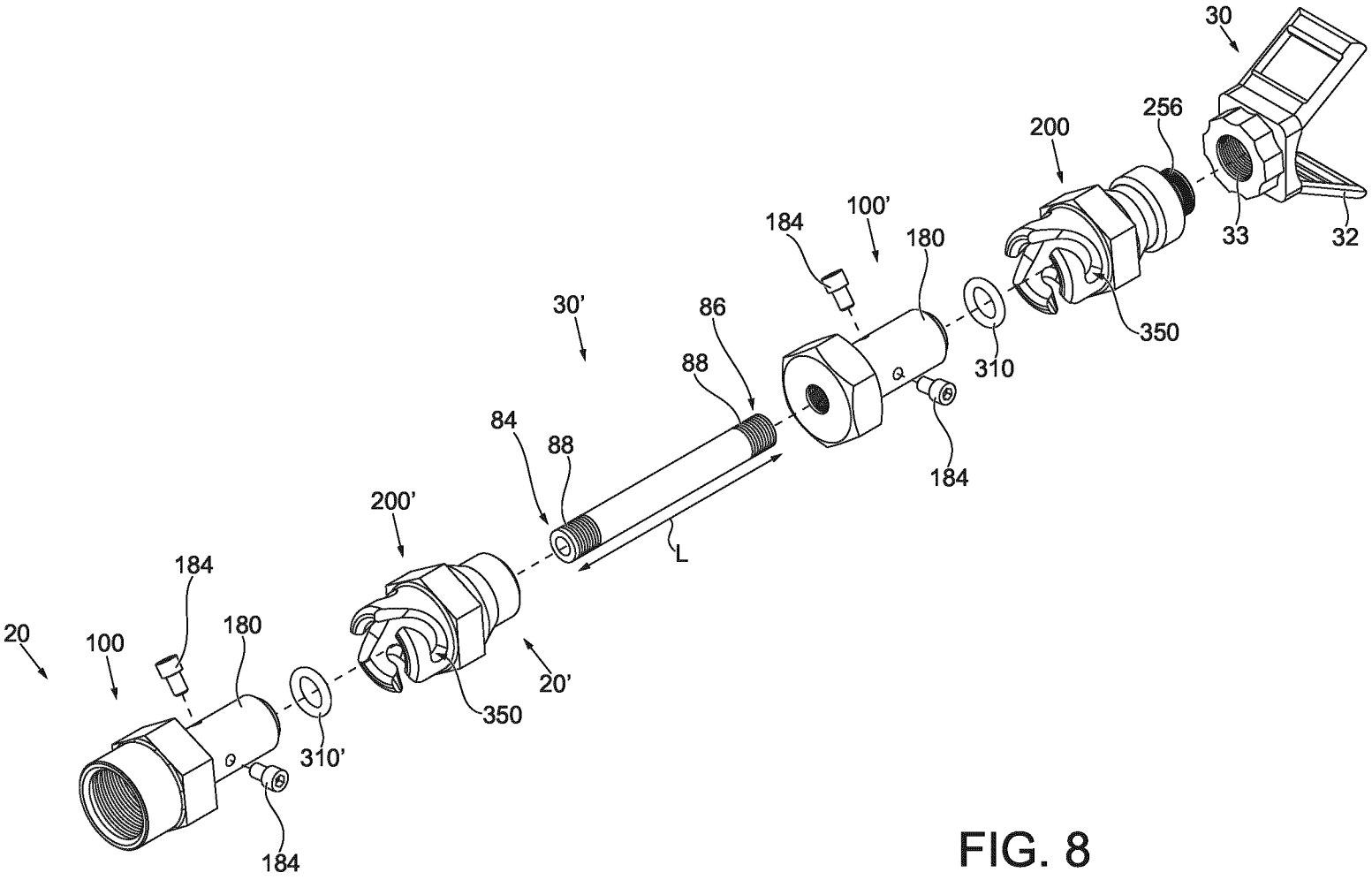
FIG. 8 is a perspective, exploded view taken from a top, right, rear side of the adapters, extension tube assembly and tip guard of FIG. 7.
Figure 9:
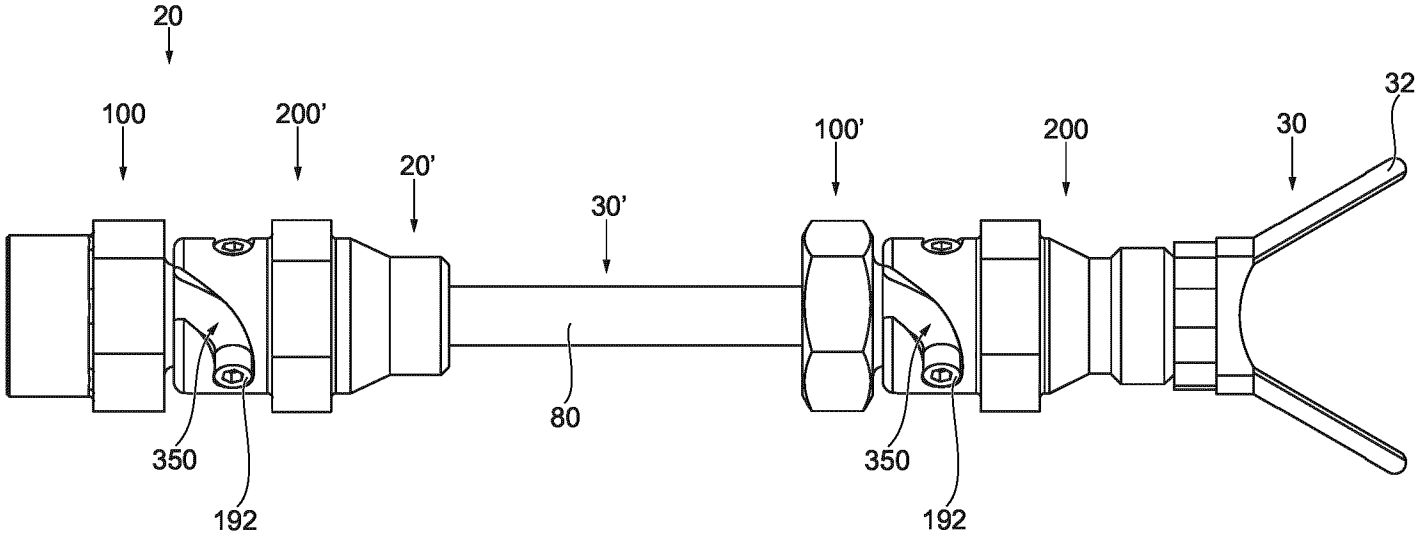
FIG. 9 is a right side elevation view of the adapters, extension tube assembly and tip guard of FIG. 7.

Referring to FIGS. 4, 6A and 6B, the downstream portion 250 has outer threads 256 located upstream of the downstream face 252. The outer threads 256 are used to selectively connect the accessory 30 having complementary threads 33 (FIG. 4) to the downstream portion 250 of the downstream connector 200. It is contemplated that a polymeric insert could be disposed between the threads 33 and the threads 256 to, for example, reduce friction therebetween and facilitate the disconnection of the accessory 30 from the downstream connector 200. The downstream body 202 of the downstream connector 200 also includes a hexagonal outer surface 230. The outer surface 230 is structured and dimensioned to be manipulated by a hand and engaged by a tool, such as a wrench, to facilitate tightening or loosening of (i) the threaded connection between the downstream connector 200 and the accessory 30, or (ii) the selective connection between the upstream and downstream connectors 100, 200 of the adapter 20, as will be described below.

Referring to FIG. 2, the upstream portion 210 of the downstream body 202 defines a groove 300 adjacent the seat 214. A gasket 310 is removably retained in the groove 300. The gasket 310 is located between the seat 170 of the upstream connector 100 and the seat 214 of the downstream connector 200 when the upstream and downstream connectors 100, 200 are connected to each other. In the present implementation and as best seen in FIG. 4, the gasket 310 has a toroidal shape (i.e. O-ring shape) and is made of a resilient polymeric material, but the gasket 310 could be of different shape and made of a different material, such as natural rubber. For example, the gasket 310 could be shaped as a flat ring having an inner diameter sized similarly to the internal bores 160, 220. As best seen in FIG. 2, the gasket 310 is resiliently compressed between the seat 170 and the seat 214. The gasket 310 forms a seal within the adapter 20 between the upstream and downstream connectors 100, 200 so as to fluidly connect the spray nozzle 52 and the accessory 30. Upstream of the groove 300, the upstream portion 210 of the downstream body 202 defines a shoulder 240. The shoulder 240 is complementary to the shoulder 176 of the upstream connector 100. The insertion of the cylindrical portion 180 of the upstream connector 100 into the downstream connector 200 is limited by the shoulder 176 abutting the shoulder 240. The structures and dimensions of the shoulders 176, 240 are selected to permit resilient compression of the gasket 310 by a sufficient amount when the upstream and downstream connectors 100, 200 are selectively connected so as to form a sealed connection therebetween.

Referring to FIGS. 4, 6A and 6B, the downstream body 202 of the downstream connector 200 further has a cylindrical base 340. Three arcuate slots 350 are defined in the downstream body 202 of the downstream connector 200. Adjacent arcuate slots 350 are angularly displaced from one another by an angular spacing 360 of 120 degrees (FIG. 4). The angular spacing 360 is the same as the angular spacing 190. Since the three arcuate slots 350 are similarly shaped and sized, only one arcuate slot 350 will be described in detail herein. The arcuate slot 350 is shaped and structured to receive one of the posts 192 of the upstream connector 100. The width of the arcuate slot 350 is larger than the diameter of the head 186 of one of the screws 184.

Referring to FIG. 6A, each arcuate slot 350 has an open end 370 defined at the base 340, and a closed end 372 located downstream of the base 340. A first section 374 extends from the open end 370 and is generally skewed with respect to the base 340. The first section 374 is partially curved, such that the most downstream portion of the first section 374 is more skewed with respect to the base 340 than the portion near the open end 370. A second section 376 extends from the first section 374 toward the closed end 372. The second section 376 extends generally circumferentially relative to the base 340. A third section 378 extends between the second section 376 and the closed end 372. The third section 378 extends from the second section 376 toward the base 340. Together, the first, second and third sections 374, 376, 378 define the arcuate shape of the slot 350.

When the upstream and downstream connectors 100, 200 are selectively connected, as shown in FIG. 3, the post 192 is in a selectively locked engagement in the arcuate slot 350 when received in the third section 378 of the arcuate slot 350. The arcuate slot 350 is shaped and sized such that, when a post 192 is initially received in the open end 370 thereof, an axial insertion and twisting of about 60 degrees of the upstream connector 100 with respect to the downstream connector 200 causes the post 192 to be received in the first, second and third sections 374, 376, 378 of the arcuate slot 350 successively, and ultimately received in the selectively locked engagement in the third section 378 of the arcuate slot 350. More particularly, as the post 192 is received in the first section 374, the seat 170 abuts the gasket 310 and starts to resiliently compress the gasket 310 against the seat 214. Then, when the post 192 is received in the second section 376, the seat 170 further compresses the gasket 310 against the seat 214. When the post 192 is received in the third section 378, the seat 170 is drawn away from the seat 214 and the compression of the gasket 310 is reduced. The post 192 remains in the selectively locked engagement in the third section 378 of the arcuate slot 350 because the resiliently compressed gasket 310 bias the upstream and downstream connectors 100, 200 apart, thereby opposing rotation of the downstream connector 200 such that the post 192 passes from the third section 378 to the second section 376 of the arcuate slot 350.

It is to be noted that combined effect of the sealed connection provided by gaskets 310 and the rotation of 60 degrees of the upstream connector 100 with respect to the downstream connector 200 for connecting the two connectors 100, 200 is advantageous compared to a conventional threaded connection since less rotational motions are required to provide a sealed connection between the two components. As such, a user who needs to connect and disconnect repeatedly the accessory 30 to and from the spray gun 40 will gain time using the adapter 20. In addition, it is contemplated that in other implementations the arcuate slots 350 could be shaped otherwise and require a rotation of the upstream connector 100 with respect to the downstream connector 200 that is exceeds 60 degrees.

Moreover, in some implementations, the angular spacing 190 between adjacent posts 192 and the angular spacing 360 between adjacent arcuate slots 350 could differ to ensure only one possible orientation of the downstream connector 200 relative to the upstream connector 100 (or vice-versa). Such configuration of the posts 192 and arcuate slots 350 could be helpful in situations where orientation of the accessory 30 relative to the spray gun 40 is of importance. For example, in an implementation where there are three posts 192 and three arcuate slots 350, a first angular spacing 190, 360 between a first pair of adjacent posts 192/arcuate slots 350 is of 60 degrees, a second angular spacing 190, 360 between a second pair of adjacent posts 192/arcuate slots 350 is of 120 degrees, and a third angular spacing 190, 360 between a third pair of adjacent posts 192/arcuate slots 350 is of 180 degrees.

As can be understood from FIGS. 1 to 6B, upon twisting of the upstream and downstream connectors 100, 200 one relative to the other, the cooperative engagement of the posts 192 in the arcuate slots 350 first draws the upstream and downstream connectors 100, 200 toward each other as the post 192 is received from the third section 378 to the second section 376 and as the gasket 310 is further compressed. Then, upon further twisting of the upstream and downstream connectors 100, 200, the cooperative engagement of the posts 192 in the arcuate slots 350 pushes apart the upstream and downstream connectors 100, 200 as the post 192 is received from the second section 376 to the first section 374.

When the upstream and downstream connectors 100, 200 are pushed apart, the seat 170 is axially drawn away from the seat 214, the shoulders 176, 240 are drawn away from each other, the gasket 310 is resiliently relaxed, and the upstream and downstream connectors 100, 200 are disconnected. As such, the accessory 30 is disconnected from the spray nozzle 52.

It is to be noted that since the gasket 310 is retained within the groove 300, the gasket 310 remains on the seat 214 even when the upstream and downstream connectors 100, 200 are disconnected. In other words, the groove 300 prevents the gasket 310 from being accidentally removed from the seat 214. However, should the gasket 310 be defective or in need of replacement, the gasket 310 is accessible from the upstream portion 210 of the downstream connector 200 for cleaning or replacement. Thus, the gasket 310 is removably retained in the groove 300.

Referring to FIGS. 3 and 4, to selectively connect separated upstream and downstream connectors 100, 200 of the adapter 20, the upstream connector 100 is positioned such that each post 192 is aligned with the open end 370 of a corresponding arcuate slot 350, and the cylindrical portion 180 is simultaneously axially inserted and twisted into the downstream body 202 of the downstream connector 200. The cooperative engagement of the posts 192 in the arcuate slots 350 draws together the upstream and downstream connectors 100, 200, which causes the seat 170 to be axially drawn toward the seat 214, the gasket 310 is resiliently compressed therebetween as the posts 192 are received successively in the first, second and third sections 374, 376, 378, and when each post 192 is received in the third section 378 of its corresponding arcuate slot 350, the upstream and downstream connectors are selectively connected. Thus, the accessory 30 is selectively connected to the spray nozzle 52.

Referring now to FIGS. 7 to 11, an accessory 30' is illustrated along with the adapter 20 and the accessory 30. The accessory 30' includes an extension tube 80. The extension tube 80 has an internal bore 82 which is sized similarly to the internal bores 160, 220 described above, and a length L of about 20 cm, but other lengths are contemplated. The extension tube 80 has upstream and downstream end portions 84, 86, which both have outer threads 88 defined thereon. The accessory 30' further includes a second adapter 20' that is similar to the adapter 20 described above. The adapter 20' includes a downstream connector 200' connected to the upstream end portion 84 of the extension tube 80, and an upstream connector 100' connected to the downstream end portion 86 of the extension tube 80.

The downstream connector 200' includes elements that are the same as or similar to those described with reference to the downstream connector 200, and the upstream connector 100' includes elements that are the same as or similar to those described with reference to the upstream connector 100. Therefore, for simplicity, elements of the upstream and downstream connectors 200', 100' that are the same as or similar to those of the upstream and downstream connectors 100, 200 have been labeled with the same reference numerals and will not be described again in detail. For example, as best seen in FIG. 10, the adapter 20' has a gasket 310' retained in a groove 300' of the downstream connector 200' just like the gasket 310 is retained in the groove 300 of the downstream connector 200.

Figure 10:
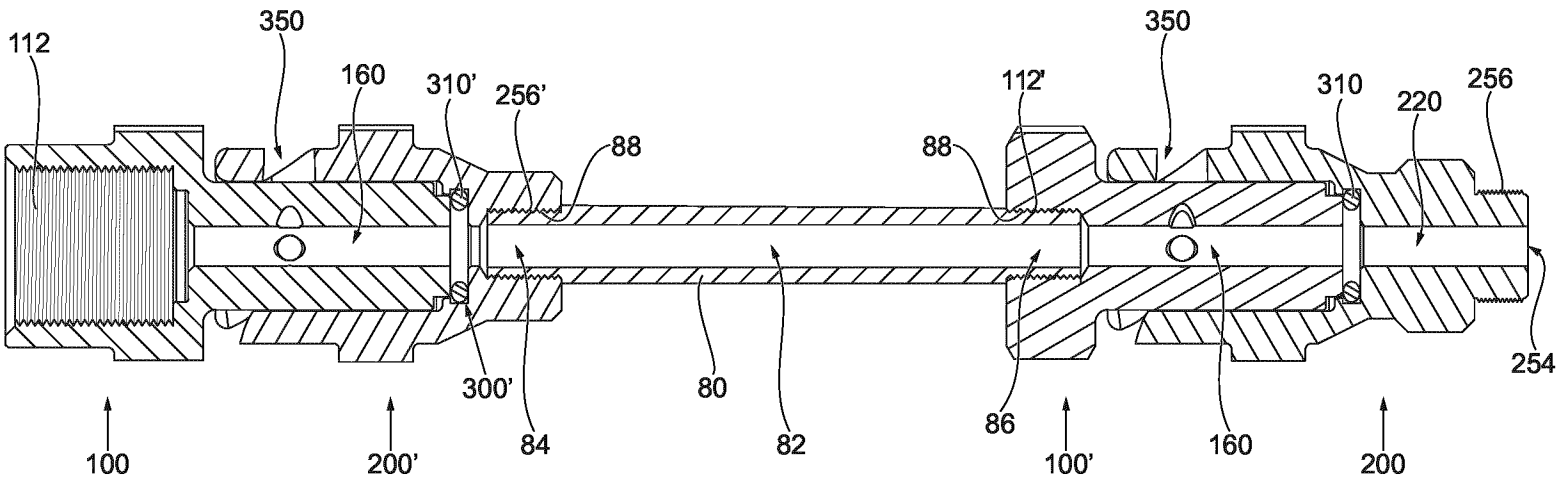
FIG. 10 is a longitudinal cross-sectional view of the adapters, extension tube assembly and tip guard of FIG. 7.

Referring to FIG. 10, the downstream connector 200' is free of outer threads 256 on the downstream portion 250 thereof, but has inner threads 256' defined in the downstream portion 250 thereof. The downstream connector 200' is threadedly connected to the upstream end portion 84 of the extension tube 80 via the threads 88, 256'. The upstream connector 100' differs from the upstream connector 100 in that the upstream connector 100' has inner threads 112' that are complementary to the outer threads 88 of the downstream end portion 86 of the extension tube 80. The upstream connector 100' is threadedly connected to the downstream end portion 86 of the extension tube 80 via the threads 88, 112'. To summarize, the accessory 30' includes the extension tube 80 with the downstream connector 200' and the upstream connector 100' connected thereto. The accessory 30' thus forms an extension tube assembly.

An illustrative scenario of the use of the adapter 20 for connecting and disconnecting different accessories 30, 30', including respectively the tip guard 32 and the extension tube 80, to the spray gun 40 is now provided. Initially and as shown in FIG. 1, the accessory 30 is connected to the spray gun 40 via the adapter 20. When a user desires to disconnect the accessory 30 from the spray gun 40 to connect the accessory 30' thereto, the user twists the upstream and downstream connectors 100, 200 one relative to the other so as to separate them. As described above, upon twisting of the upstream and downstream connectors 100, 200 one relative to the other, the cooperative engagement of the posts 192 in the arcuate slots 350 pushes apart the upstream and downstream connectors 100, 200, causing the accessory 30 to be selectively disconnected from the spray nozzle 52. The user puts away the assembly formed by downstream connector 200 and the accessory 30, which remain threadedly connected together.

The user then manipulates the accessory 30' such that the cylindrical portion 180 of the upstream connector 100 is inserted into the downstream connector 200' of the adapter 20'. To selectively connect the upstream connector 100 to the downstream connector 200', each post 192 is initially received in the open end 370 of a corresponding arcuate slot 350 of the downstream connector 200', and upon axial insertion and twisting of about 60 degrees of the upstream connector 100 with respect to the downstream connector 200', each post 192 is received in a selectively locked engagement in the third section 378 of the corresponding arcuate slot 350.

Figure 11:
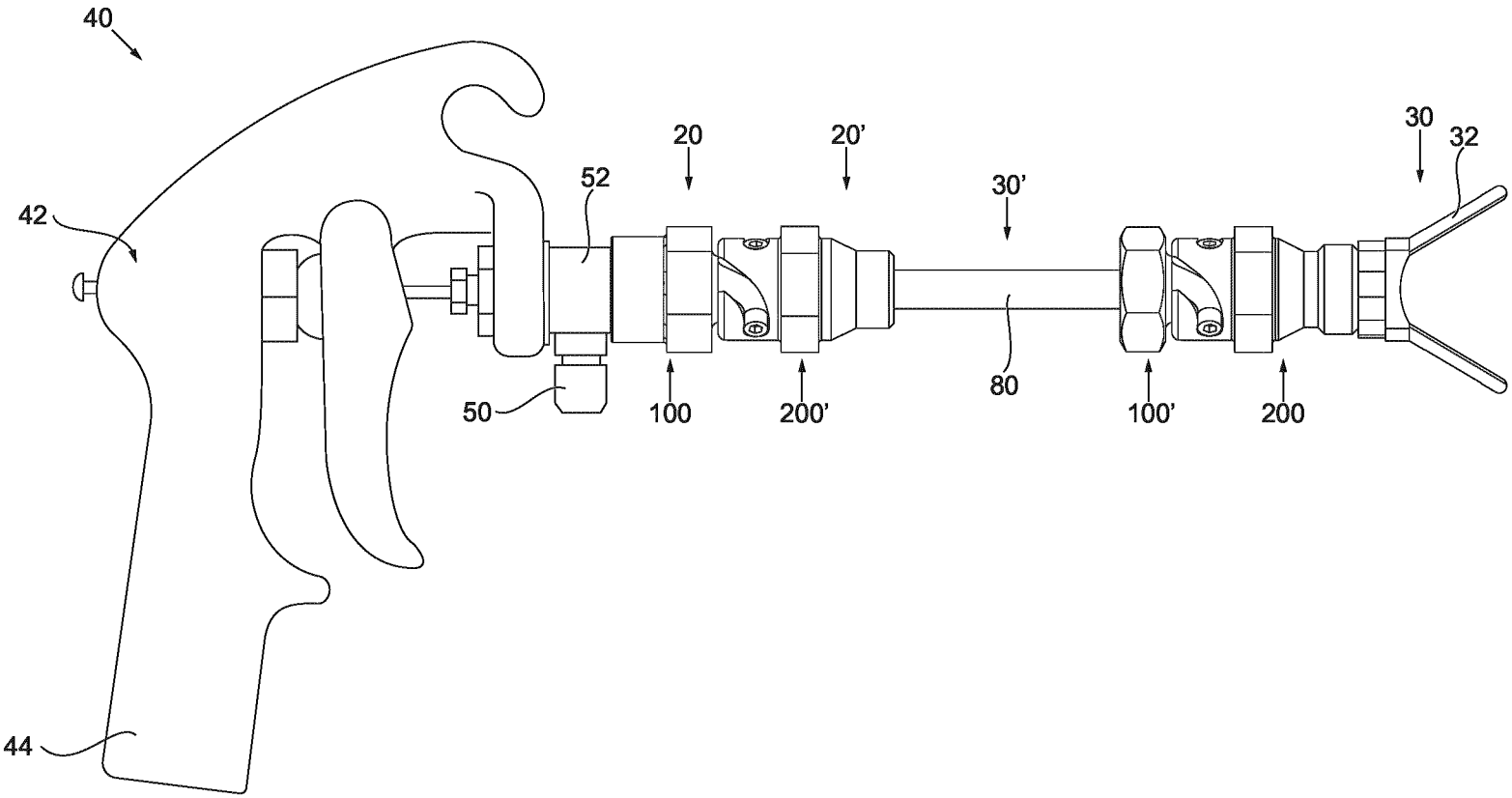
FIG. 11 is a right side elevation view of the adapters, extension tube assembly and tip guard of FIG. 7 connected to a spray gun.
Figure 12:
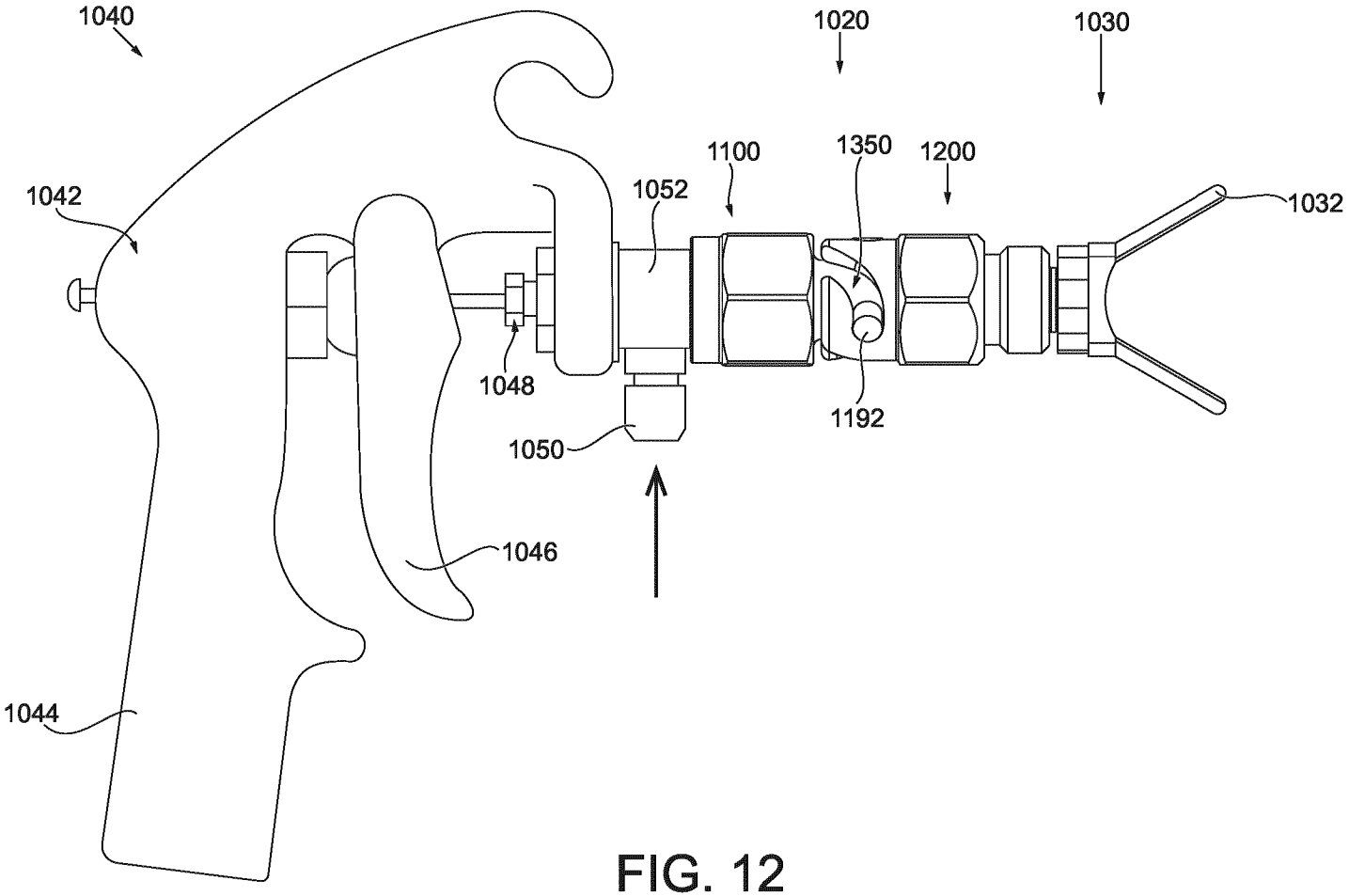
FIG. 12 is a right side elevation view of a spray gun with an adapter in accordance with a second implementation of the present technology, the adapter selectively connecting the spray gun to a tip guard.
Figure 13:
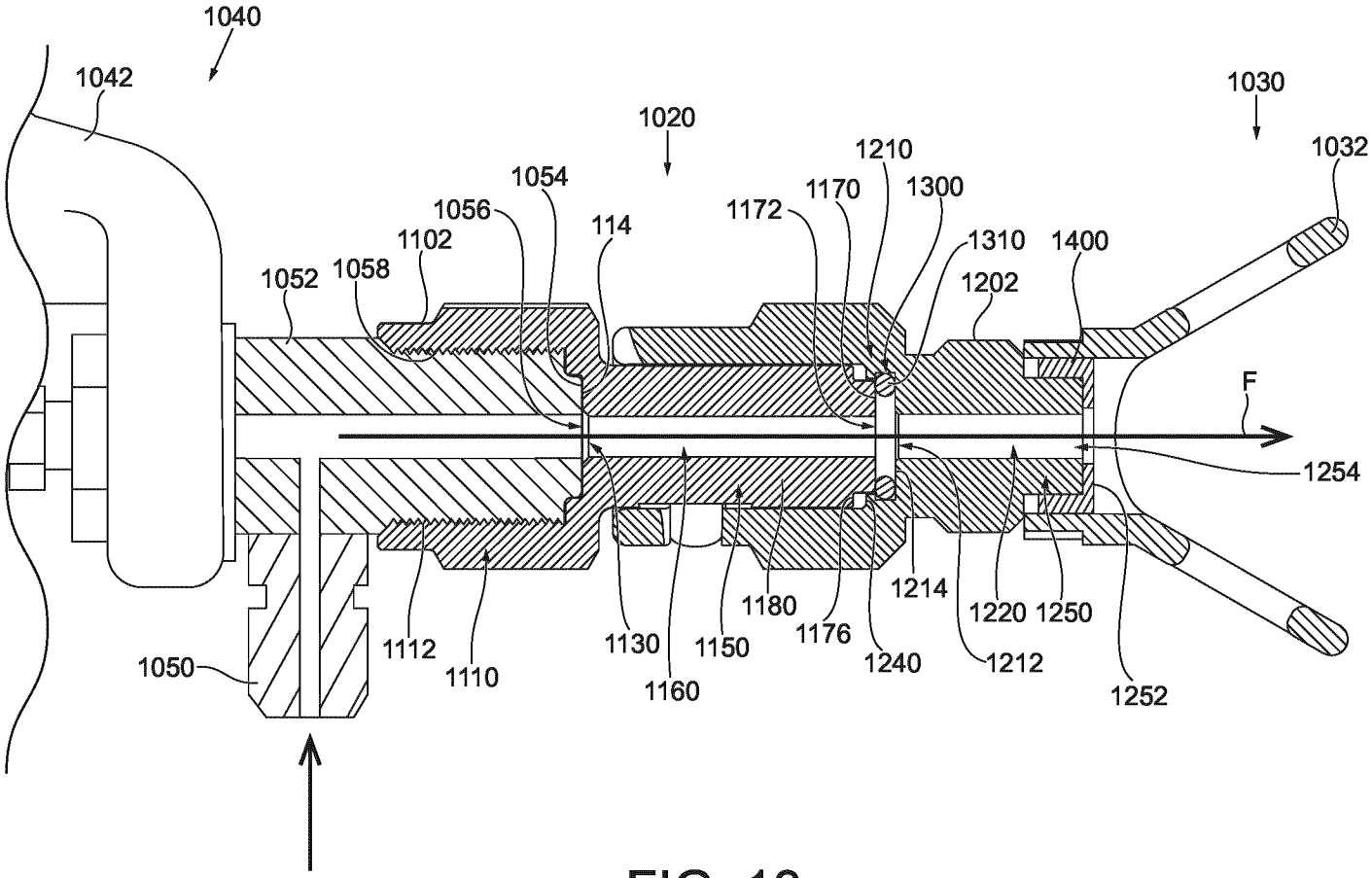
FIG. 13 is a longitudinal cross-sectional view of the adapter, the tip guard and a spray nozzle of the spray gun of FIG. 12.
Figure 14:
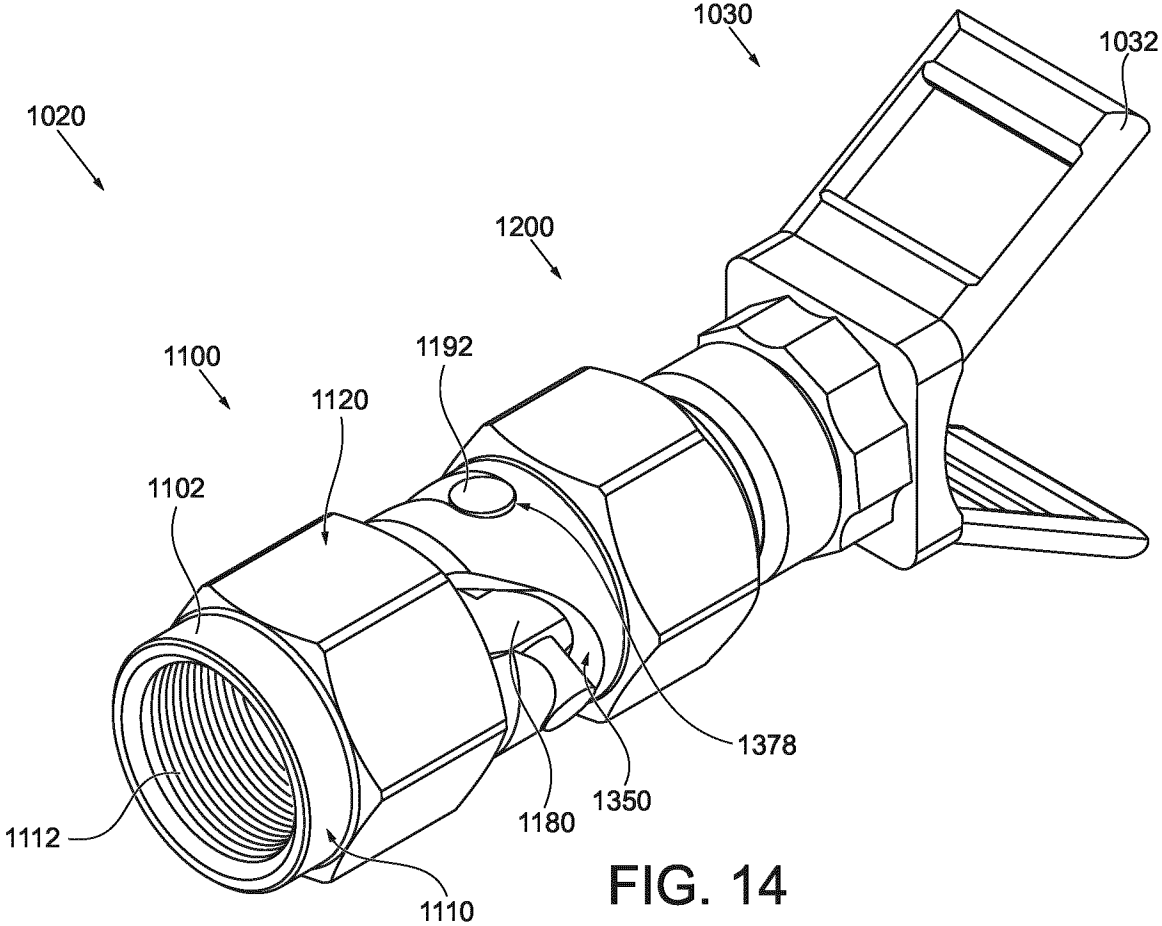
FIG. 14 is a perspective view taken from a top, right, rear side of the adapter and tip guard of FIG. 12.

If needed, the assembly formed by downstream connector 200 and the accessory 30 is selectively connected to the upstream connector 100' of the accessory 30', so as to have an assembly of a spray gun 40, an extension tube 80, and a tip guard 32 interconnected using the adapters 20, 20', as shown in FIG. 11.

When the user no longer needs the accessory 30' including the extension tube 80, the user twists the upstream connector 100 relative to the downstream connector 200' so as to separate them. As described above, the cooperative engagement of the posts 192 in the arcuate slots 350 pushes apart the upstream and downstream connectors 100, 200', causing the accessory 30' to be selectively disconnected from the spray nozzle 52. If needed, the assembly formed by downstream connector 200 and the accessory 30 is selectively disconnected from the upstream connector 100' of the accessory 30' in a similar manner, and is selectively connected back to the upstream connector 100 to revert to the initial configuration shown in FIG. 1.

It is contemplated that in an alternative implementation, the upstream connector 100 could be structured for receiving a cylindrical portion 180 provided on the downstream connector 200, and the upstream connector 100 could have the arcuate slots 350 defined therein for receiving the posts 192 provided on the downstream connector 200.

In accordance with another aspect of the present technology, it is also contemplated that the downstream connector 200 having the downstream body 202 could be configured to be connected to one of the spray gun 40 and the accessory 30. As such, the other one of the spray gun 40 and the accessory 30 could have the upstream connector 100 connected thereto. In some implementations, it is contemplated that the upstream and downstream connectors 100, 200 could be integral with the spray gun 40 or the accessory 30. In such an implementation, the accessory 30 could be connected to the spray gun 20 using the principle of the adapter 20 described above, but without the need of providing the adapter 20 to interconnect them.

As will be described below with reference to FIGS. 12 to 22, the second implementation of an adapter 1020 for selectively connecting the accessory 1030 to the spray gun 1040 will be described. The adapter 1020, the accessory 1030 and the spray gun 1040 include elements that are the same as or similar to those described with reference to the adapter 20, the accessory 30 and the spray gun 40. Therefore, for simplicity, elements of the adapter 1020, the accessory 1030 and the spray gun 1040 that are the same as or similar to those of adapter 20, the accessory 30 and the spray gun 40 have been labeled with the same reference numerals, but with the reference numeral in the 1000 series, and will not be described again in detail.

In addition, the accessory 1030', which is an extension tube assembly, includes elements that are the same as or similar to those described with reference to the accessory 30'. Therefore, for simplicity, elements of the accessory 1030' that are the same as or similar to those of the accessory 30' have been labeled with the same reference numerals, but with the reference numerals in the 1000 series, and will not be described again in detail.

Figure 15:
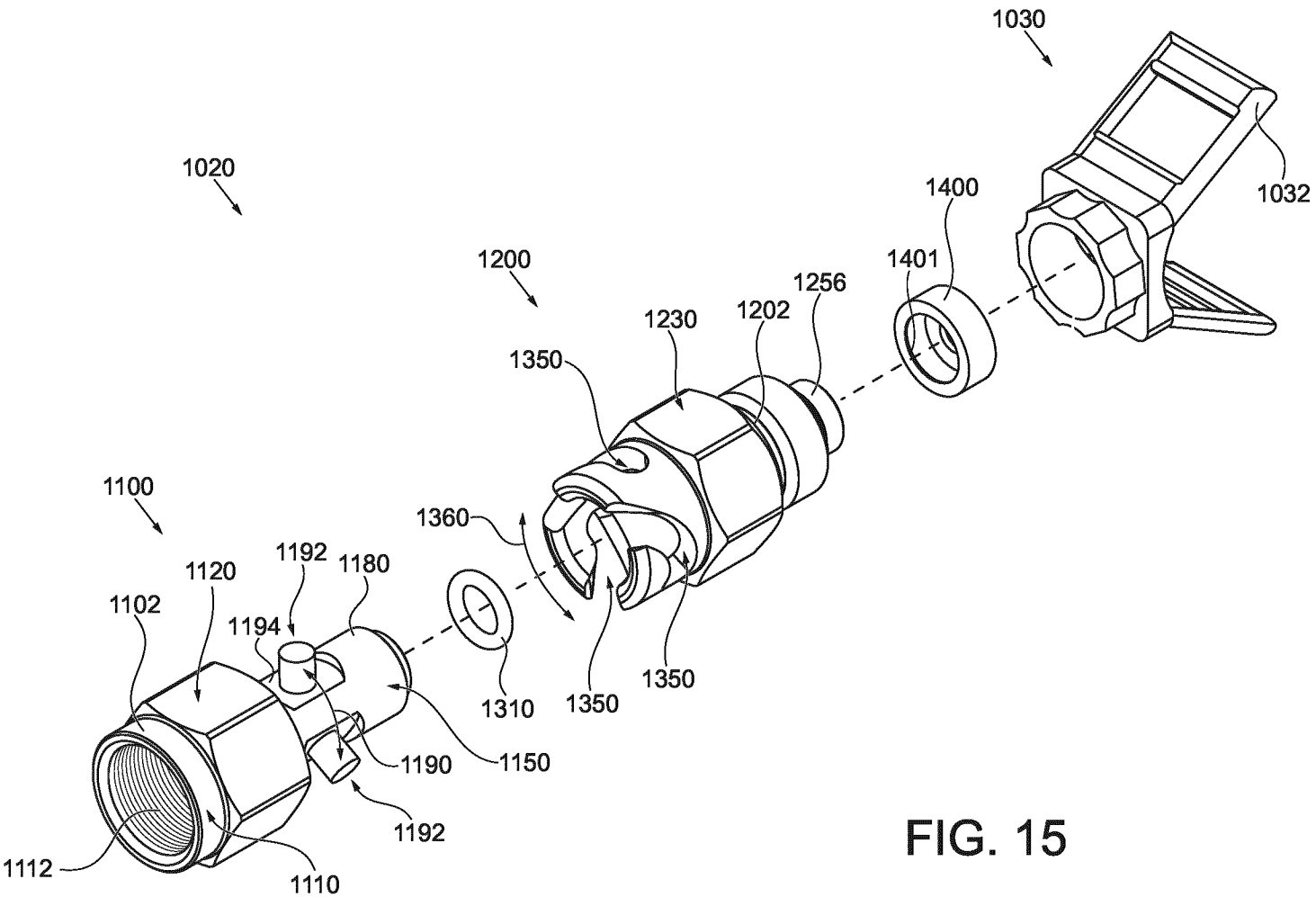
FIG. 15 is a perspective exploded view taken from a top, right, rear side of the adapter and tip guard of FIG. 14.
Figure 16A:
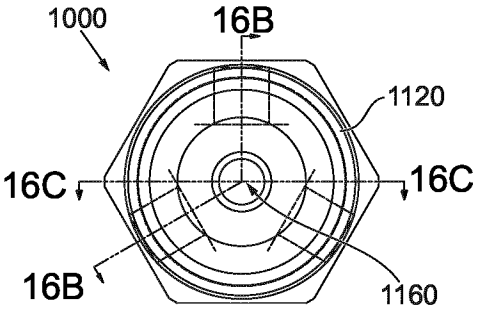
FIG. 16A is a rear elevation view of an upstream connector of the adapter of FIG. 12, with three posts shown in phantom lines.
Figure 16C:
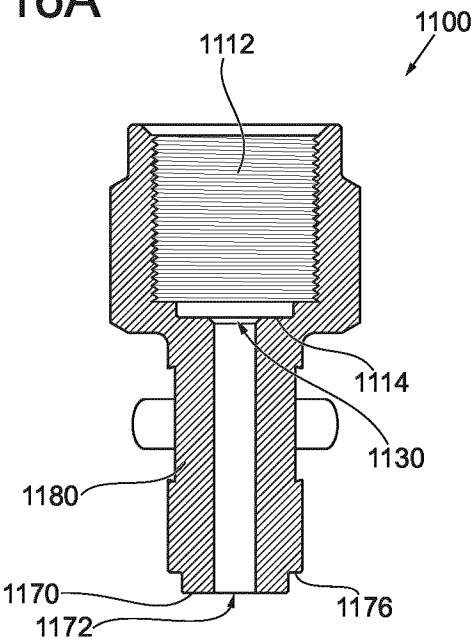
FIG. 16C is a cross-sectional view of the upstream connector of FIG. 16A taken along cross-section line 16C-16C of FIG. 16A.
Figure 16B:
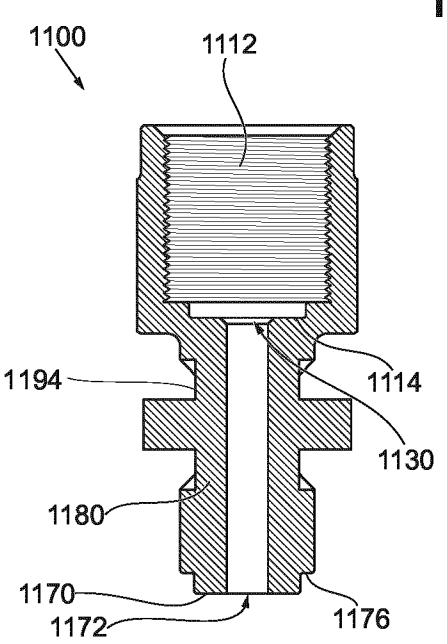
FIG. 16B is a cross-sectional view of the upstream connector of FIG. 16A taken along cross-section line 16B-16B of FIG. 16A.

Referring to FIGS. 15 to 16C, in the present implementation, the posts 1192 are integral with the body 1102 of the upstream connector 1100. The cylindrical portion 1180 has three flat surfaces 1194 defined thereon, and the posts 1192 project from the flat surfaces 1194. The flat surfaces 1194 are formed during the machining of the body 1102 of the upstream connector 1100, leaving the posts 1192 projecting as shown in FIGS. 15 to 16C. Having the posts 1192 integral with the body 1102 of the upstream connector 1100 reduces the number of components of the adapter 1020.

Figure 17A:
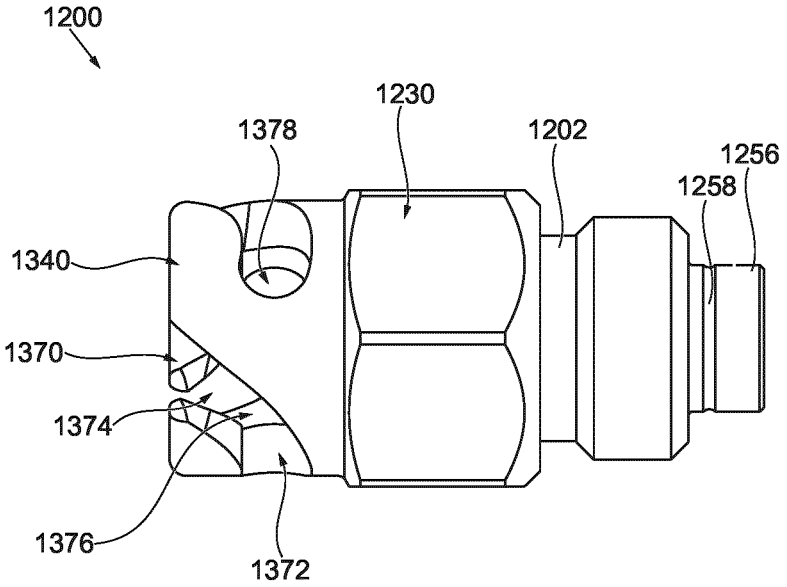
FIG. 17A is a right side elevation view of a downstream connector of the adapter of FIG. 12.
Figure 17B:
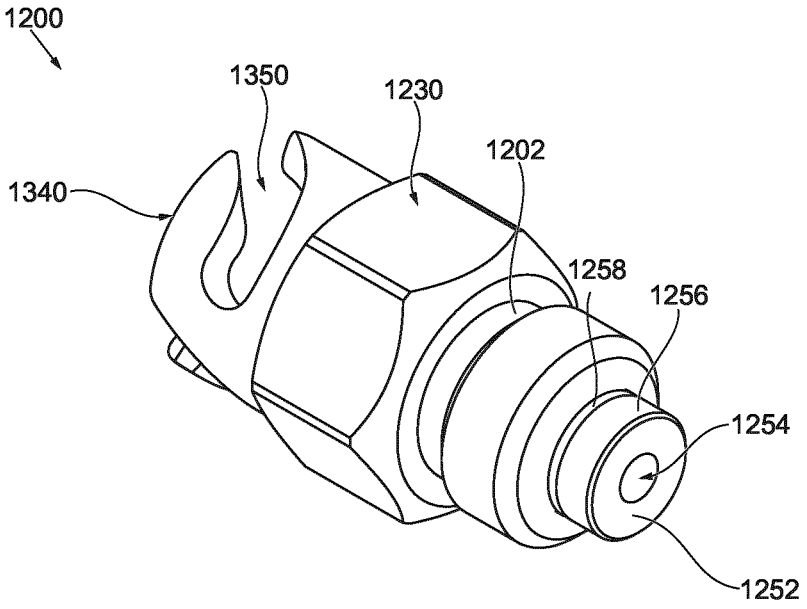
FIG. 17B is a perspective view taken from a front, right side of the downstream connector of FIG. 17A.
Figure 18:
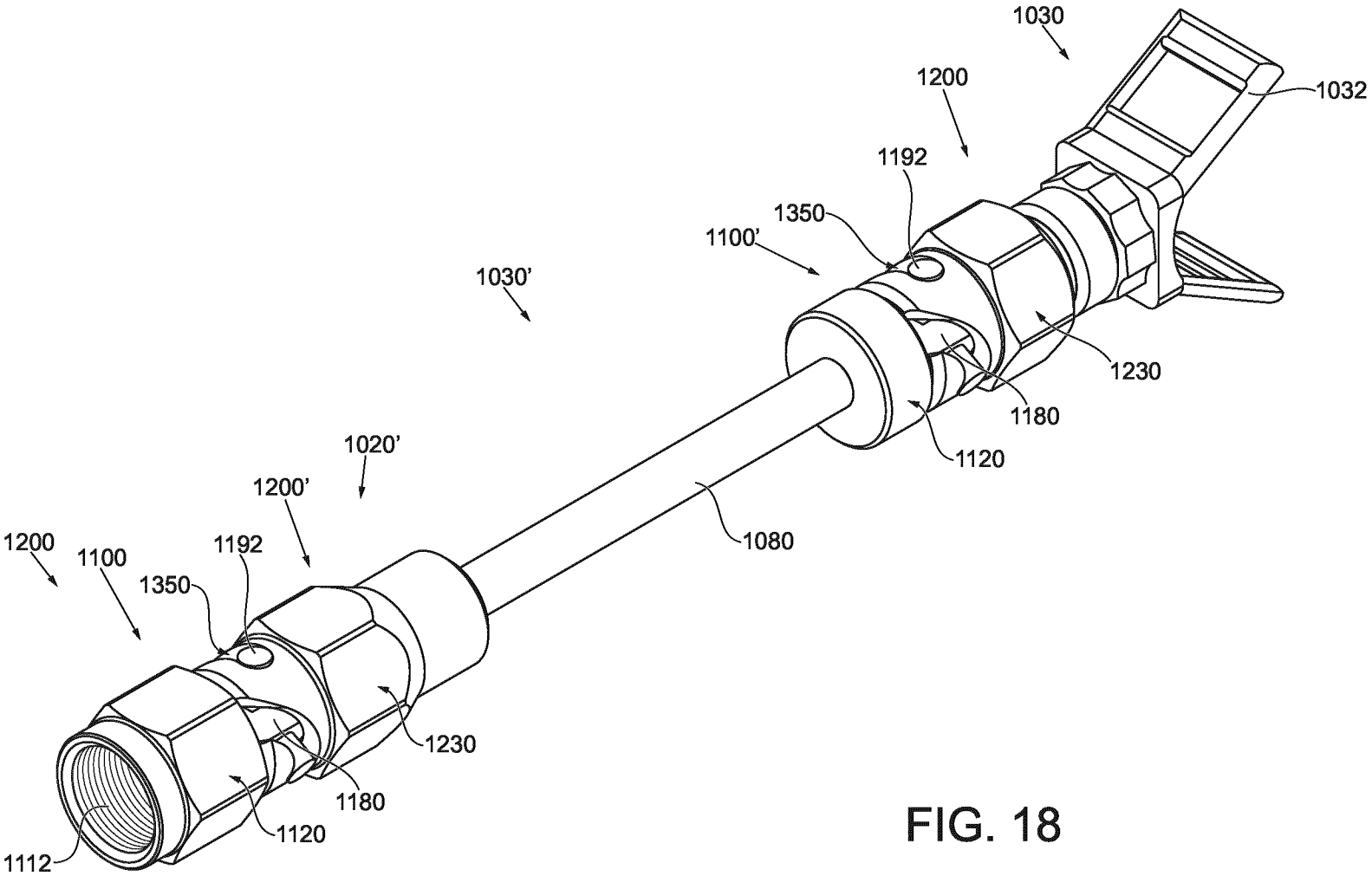
FIG. 18 is a perspective view taken from a top, right, rear side of the adapter of FIG. 12, with an extension tube assembly selectively connected thereto, the extension assembly including a second adapter, and the tip guard of FIG. 12 selectively connected to the extension tube assembly.
Figure 19:
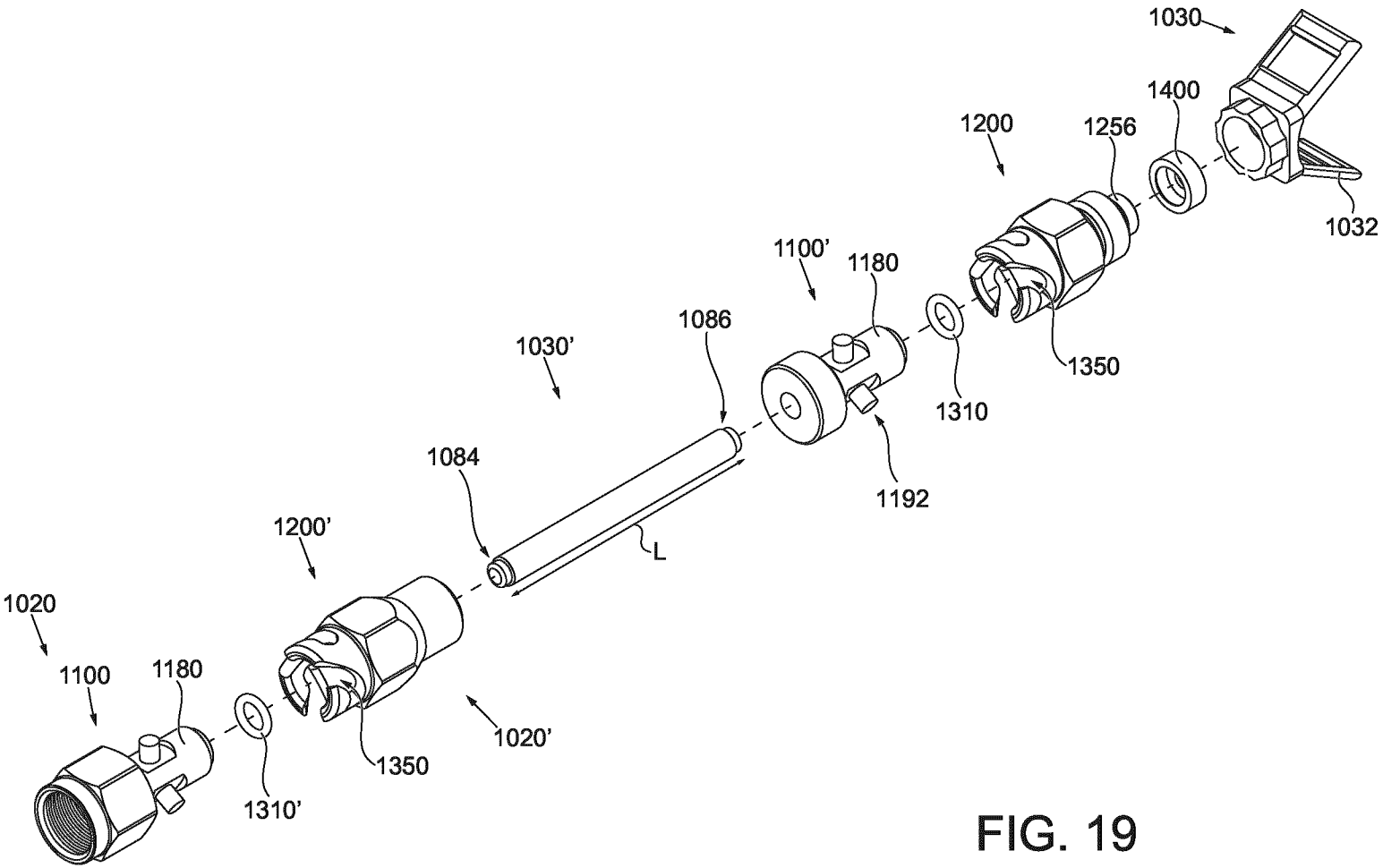
FIG. 19 is a perspective, exploded view taken from a top, right, rear side of the adapters, extension tube assembly and tip guard of FIG. 18.
Figure 20:
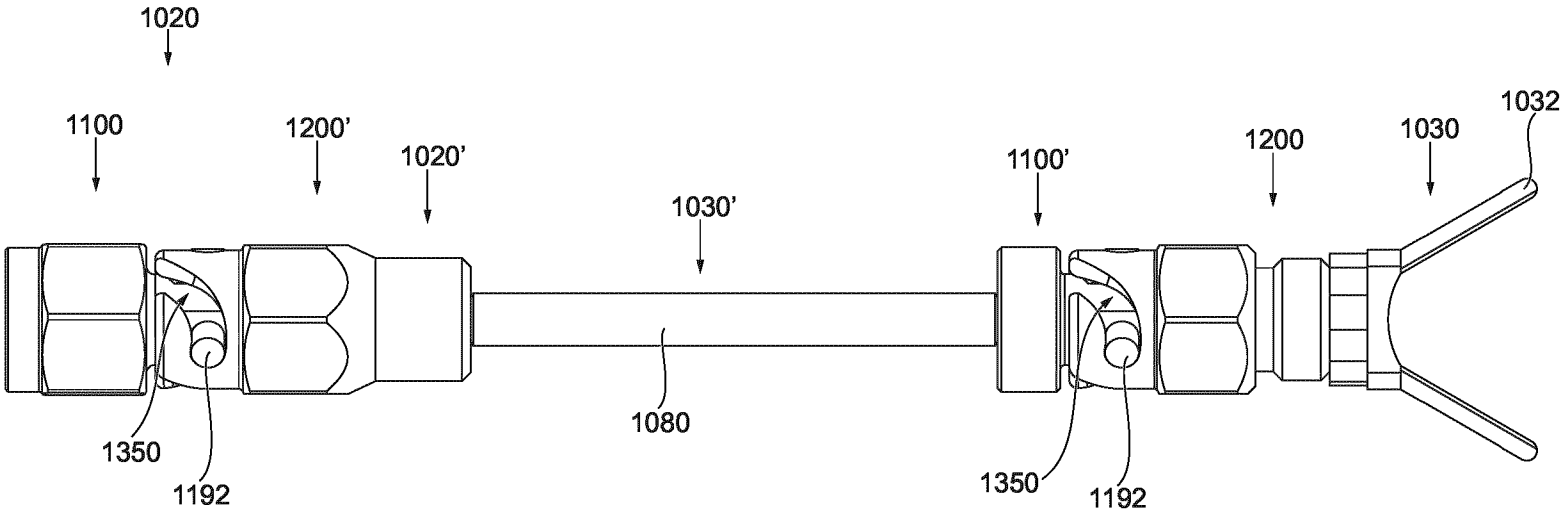
FIG. 20 is a right side elevation view of the adapters, extension tube assembly and tip guard of FIG. 18.
Figure 21:
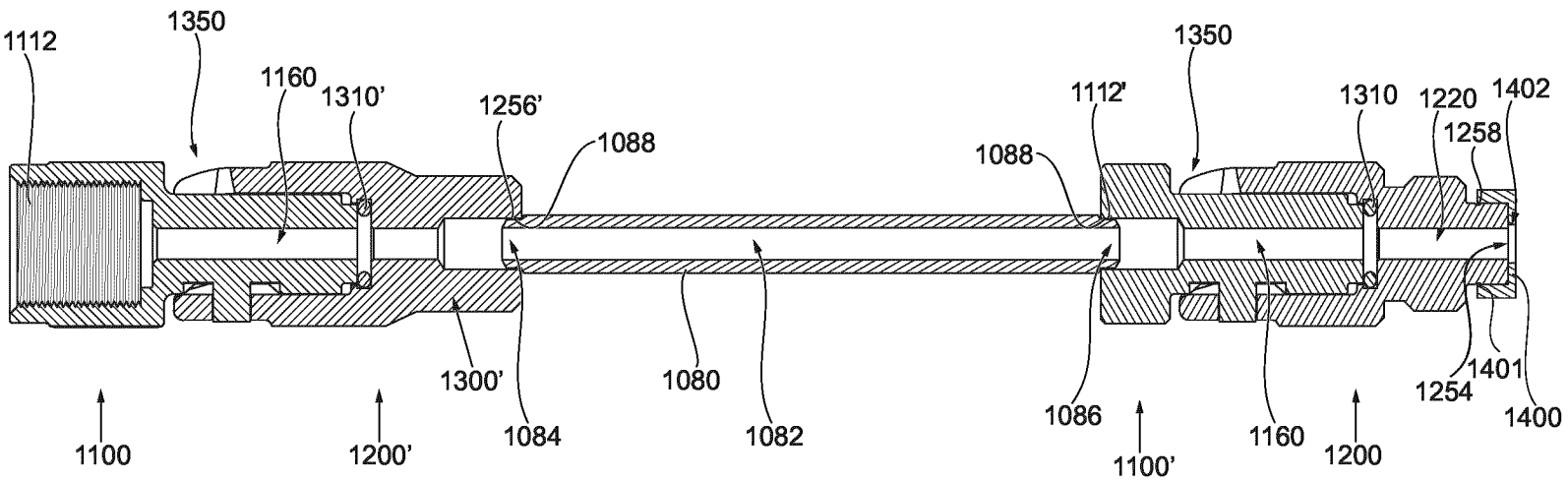
FIG. 21 is a longitudinal cross-sectional view of the adapters, extension tube assembly and tip guard of FIG. 18.
Figure 22:
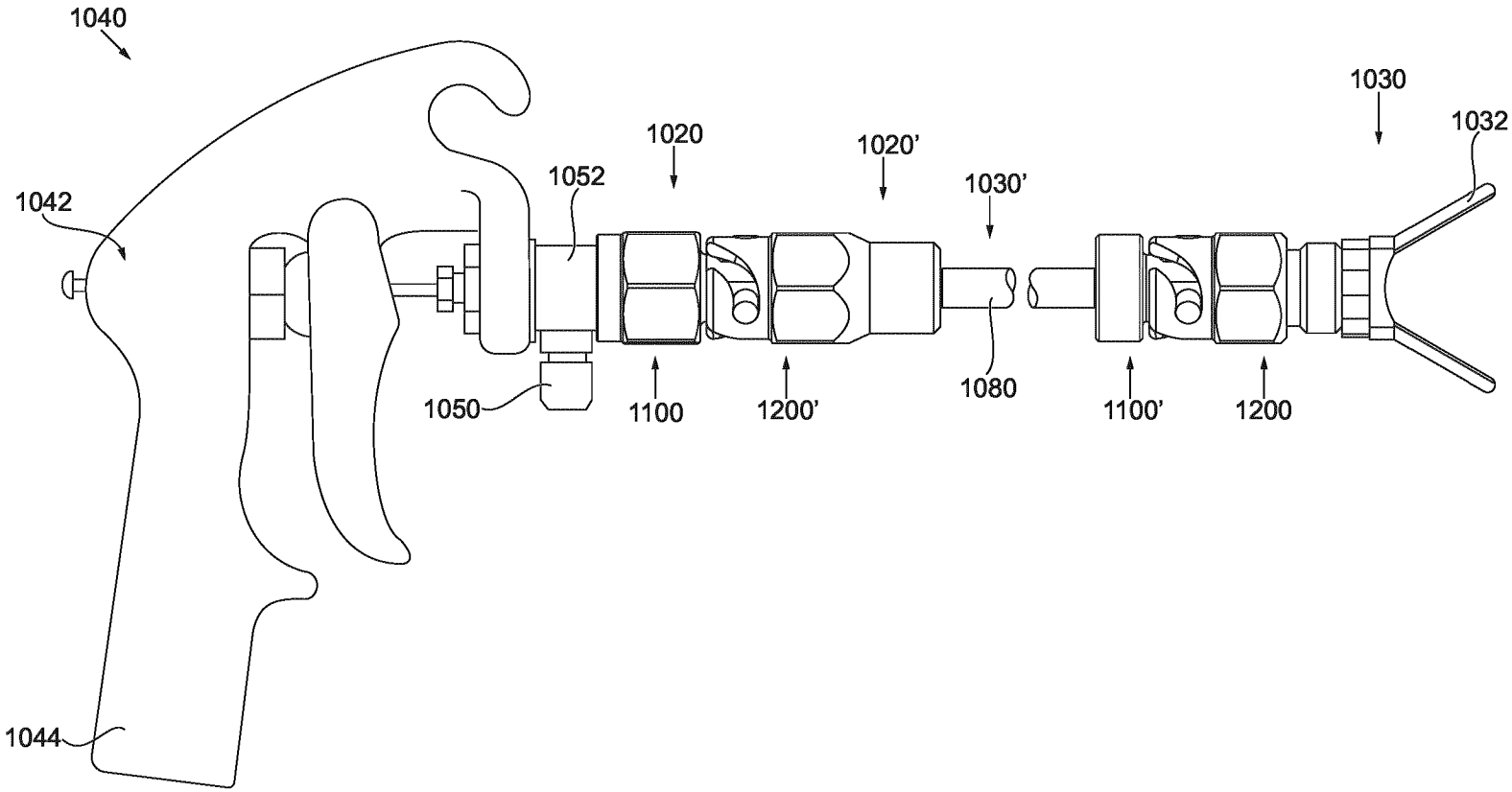
FIG. 22 is a right side elevation view of the adapters, extension tube assembly and tip guard of FIG. 19 connected to a spray gun.

Referring to FIGS. 15, 19 and 21, the adapter 1020 further has a cap 1400 disposed between the tip guard 1032 and the downstream connector 1200. As best seen in FIGS. 15, 17A, 17B and 21, the cap 1400 has a lip portion 1401 that is engaged in a groove 1258 defined in the downstream connector 1200 (FIG. 17A). As such, the cap 1400 is retained on the downstream connector 1200. The cap 1400 is made of a polymeric material that has a relatively low friction coefficient, thereby facilitating the removal of the tip guard 1032 from the downstream connector 1200 in some conditions. In some implementations, the cap 1400 is made of polyoxymethylene. In some implementations where the tip guard 1032 is rotatively connected to the downstream connector 1200, the cap 1400 may facilitate, in some condition, the rotation of the tip guard 1032 relative to the downstream connector 1200. The cap 1400 also has a bore 1402 defined therein (FIG. 21). The diameter of the bore 1402 is greater than the diameter of the bore 1220. As such, the cap 1400 does not impede flow of paint when flowing from the spray nozzle 1052 and on to the tip guard 1032. In some implementations, an additional cap 1400 is disposed between the spray nozzle 52 and the inner threads 112 of the upstream connector 100 to facilitate, in some conditions, removal of the upstream connector 100 from the spray nozzle 52.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

The invention claimed is:

1. An adapter for selectively connecting an accessory to a spray gun having a spray nozzle, the adapter comprising:

an upstream connector for selectively connecting to the spray nozzle of the spray gun, the upstream connector having an upstream body including:

an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice;

a downstream connector being selectively connected to the upstream connector, the downstream connector having a downstream body including:

an upstream portion defining an upstream orifice, and a second seat facing the upstream connector and surrounding the upstream orifice, a downstream portion for connecting to the accessory, and the downstream body defining an internal bore fluidly connected to the internal bore of the upstream connector; and a gasket located between the first and second seats, the gasket being resiliently compressed between the first and second seats to form a seal between the upstream connector and the downstream connector, the upstream connector having a cylindrical portion at least partially inserted into the downstream connector, and at least one post projecting radially from the cylindrical portion, the downstream body having a cylindrical base, the base having at least one arcuate slot defined therein, the at least one arcuate slot being shaped and structured to receive the at least one post of the upstream connector, the at least one arcuate slot having:

an open end defined at the base of the downstream body and a closed end, a first section extending from the open end and being skewed with respect to the base, a second section extending from the first section toward the closed end, the second section extending generally circumferentially relative to the base, a third section extending between the second section and the closed end, the third section extending from the second section toward an upstream end of the downstream body, and the at least one post is in a selectively locked engagement in the at least one arcuate slot when received in the third section of the at least one arcuate slot, and to connect disconnected upstream and downstream connectors, the cylindrical portion is simultaneously axially inserted and twisted into the downstream connector, and cooperative engagement of the at least one post in the at least one arcuate slot draws together the upstream and downstream connectors, causing the first seat to be axially drawn toward the second seat, resiliently compressing the gasket therebetween and connecting the upstream connector to the downstream connector.

2. The adapter of claim 1, wherein, to disconnect connected upstream and downstream connectors, the upstream connector is twisted relative to the downstream connector, and cooperative engagement of the at least one post in the at least one arcuate slot pushes apart the upstream and downstream connectors, causing the first seat to be axially drawn away from the second seat, resiliently relaxing the gasket and disconnecting the upstream connector from the downstream connector.

3. The adapter of claim 1, wherein the downstream body defines a groove, the groove being adjacent the second seat, the gasket being removably retained in the groove.

4. The adapter of claim 1, wherein the internal bores of the upstream and downstream bodies are coaxial.

5. The adapter of claim 1, wherein the upstream connector has a thread for connecting to the spray nozzle.

6. The adapter of claim 1, wherein each of the upstream and downstream bodies includes a hexagonal outer surface.

7. The adapter of claim 1, wherein the at least one post is integral with the upstream connector.

8. A spray gun assembly comprising:

a spray gun, at least one accessory, and at least one adapter according to claim 1 connecting the spray gun and the at least one accessory together.

9. An adapter for selectively connecting an accessory to a spray gun having a spray nozzle, the adapter comprising:

an upstream connector for selectively connecting to the spray nozzle of the spray gun, the upstream connector having an upstream body including:

an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice;

a downstream connector being selectively connected to the upstream connector, the downstream connector having a downstream body including:

an upstream portion defining an upstream orifice, and a second seat facing the upstream connector and surrounding the upstream orifice, a downstream portion for connecting to the accessory, the downstream body defining an internal bore fluidly connected to the internal bore of the upstream connector, and the internal bores of the upstream and downstream bodies have a same diameter; and a gasket located between the first and second seats, the gasket being resiliently compressed between the first and second seats to form a seal between the upstream connector and the downstream connector, one of the upstream and downstream connectors having a cylindrical portion at least partially inserted into another one of the upstream and downstream connectors, and at least one post projecting radially from the cylindrical portion, the other one of the upstream and downstream connectors having at least one arcuate slot defined therein, the at least one arcuate slot being shaped and structured to receive the at least one post of the one of the upstream and downstream connectors, and to connect disconnected upstream and downstream connectors, the cylindrical portion is simultaneously axially inserted and twisted into the other one of the upstream and downstream connectors, and cooperative engagement of the at least one post in the at least one arcuate slot draws together the upstream and downstream connectors, causing the first seat to be axially drawn toward the second seat, resiliently compressing the gasket therebetween and connecting the upstream connector to the downstream connector.

10. An adapter for selectively connecting an accessory to a spray gun having a spray nozzle, the adapter comprising:

an upstream connector for selectively connecting to the spray nozzle of the spray gun, the upstream connector having an upstream body including:

an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice;

a downstream connector being selectively connected to the upstream connector, the downstream connector having a thread for connecting to the accessory, the downstream connector having a downstream body including:

an upstream portion defining an upstream orifice, and a second seat facing the upstream connector and surrounding the upstream orifice, a downstream portion for connecting to the accessory, and the downstream body defining an internal bore fluidly connected to the internal bore of the upstream connector; and a gasket located between the first and second seats, the gasket being resiliently compressed between the first and second seats to form a seal between the upstream connector and the downstream connector, one of the upstream and downstream connectors having a cylindrical portion at least partially inserted into another one of the upstream and downstream connectors, and at least one post projecting radially from the cylindrical portion, the other one of the upstream and downstream connectors having at least one arcuate slot defined therein, the at least one arcuate slot being shaped and structured to receive the at least one post of the one of the upstream and downstream connectors, and to connect disconnected upstream and downstream connectors, the cylindrical portion is simultaneously axially inserted and twisted into the other one of the upstream and downstream connectors, and cooperative engagement of the at least one post in the at least one arcuate slot draws together the upstream and downstream connectors, causing the first seat to be axially drawn toward the second seat, resiliently compressing the gasket therebetween and connecting the upstream connector to the downstream connector.

11. An adapter for selectively connecting an accessory to a spray gun having a spray nozzle, the adapter comprising:

an upstream connector for selectively connecting to the spray nozzle of the spray gun, the upstream connector having an upstream body including:

an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice;

a downstream connector being selectively connected to the upstream connector, the downstream connector having a downstream body including:

an upstream portion defining an upstream orifice, and a second seat facing the upstream connector and surrounding the upstream orifice, a downstream portion for connecting to the accessory, and the downstream body defining an internal bore fluidly connected to the internal bore of the upstream connector; and a gasket located between the first and second seats, the gasket being resiliently compressed between the first and second seats to form a seal between the upstream connector and the downstream connector, one of the upstream and downstream connectors having a cylindrical portion at least partially inserted into another one of the upstream and downstream connectors, and three posts projecting radially from the cylindrical portion, adjacent posts being angularly spaced from one another by an angular spacing;

the other one of the upstream and downstream connectors having three arcuate slots defined in the body thereof, adjacent arcuate slots being angularly spaced from one another by the angular spacing, each of the three arcuate slots being shaped and structured to receive a corresponding one of the three posts of the one of the upstream and downstream connectors, and to connect disconnected upstream and downstream connectors, the cylindrical portion is simultaneously axially inserted and twisted into the other one of the upstream and downstream connectors, and cooperative engagement of the at least one post in the at least one arcuate slot draws together the upstream and downstream connectors, causing the first seat to be axially drawn toward the second seat, resiliently compressing the gasket therebetween and connecting the upstream connector to the downstream connector.

12. The adapter of claim 11, wherein the angular spacing is of 120 degrees.

13. A spray gun assembly comprising:

a spray gun, the spray gun being one of an airless paint sprayer and an air-assisted paint sprayer, at least one accessory, and at least one adapter connecting the spray gun and the at least one accessory together, the at least one adapter comprising:

an upstream connector for selectively connecting to a spray nozzle of the spray gun, the upstream connector having an upstream body including:

an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice;

a downstream connector being selectively connected to the upstream connector, the downstream connector having a downstream body including:

an upstream portion defining an upstream orifice, and a second seat facing the upstream connector and surrounding the upstream orifice, a downstream portion for connecting to the at least one accessory, and the downstream body defining an internal bore fluidly connected to the internal bore of the upstream connector; and a gasket located between the first and second seats, the gasket being resiliently compressed between the first and second seats to form a seal between the upstream connector and the downstream connector, one of the upstream and downstream connectors having a cylindrical portion at least partially inserted into another one of the upstream and downstream connectors, and at least one post projecting radially from the cylindrical portion, the other one of the upstream and downstream connectors having at least one arcuate slot defined therein, the at least one arcuate slot being shaped and structured to receive the at least one post of the one of the upstream and downstream connectors, and to connect disconnected upstream and downstream connectors, the cylindrical portion is simultaneously axially inserted and twisted into the other one of the upstream and downstream connectors, and cooperative engagement of the at least one post in the at least one arcuate slot draws together the upstream and downstream connectors, causing the first seat to be axially drawn toward the second seat, resiliently compressing the gasket therebetween and connecting the upstream connector to the downstream connector.

14. A spray gun assembly comprising:

a spray gun having a spray nozzle;

a first accessory having first and second end portions;

a first adapter connecting the spray gun to the first end portion of the first accessory; and a second adapter connected to the second end portion of the first accessory, the first adapter comprising:

a first upstream connector selectively connected to the spray nozzle of the spray gun, the first upstream connector having a first upstream body including:

an upstream portion for connecting to the spray nozzle, a downstream portion defining a downstream orifice, the downstream portion having a first seat facing opposite to the upstream portion and surrounding the downstream orifice, and the upstream body defining an internal bore extending between the upstream and downstream portions for fluidly connecting the spray nozzle to the downstream orifice;

a first downstream connector selectively connected to the first upstream connector, the first downstream connector having a first downstream body including:

an upstream portion defining an upstream orifice, and a second seat facing the upstream connector and surrounding the upstream orifice, a downstream portion for connecting to the first accessory, and the downstream body defining an internal bore fluidly connected to the internal bore of the upstream connector; and a first gasket located between the first and second seats, the first gasket being resiliently compressed between the first and second seats to form a seal between the first upstream connector and the first downstream connector, one of the first upstream and first downstream connectors having a first cylindrical portion at least partially inserted into another one of the first upstream and first downstream connectors, and at least one first post projecting radially from the first cylindrical portion, and the other one of the first upstream and first downstream connectors having at least one first arcuate slot defined therein, the at least one first arcuate slot being shaped and structured to receive the at least one first post of the one of the first upstream and first downstream connectors; and the second adapter comprising:

a second upstream connector selectively connected to the first accessory, the second upstream connector having a second upstream body including:

an upstream portion for connecting to the first accessory, a downstream portion defining a downstream orifice, the downstream portion having a first seat facing opposite to the upstream portion and surrounding the downstream orifice, and the upstream body defining an internal bore extending between the upstream and downstream portions for fluidly connecting the first accessory to the downstream orifice;

a second downstream connector selectively connected to the second upstream connector, the second downstream connector having a second downstream body including:

an upstream portion defining an upstream orifice, and a second seat facing the upstream connector and surrounding the upstream orifice, a downstream portion for connecting to a second accessory, and the downstream body defining an internal bore fluidly connected to the internal bore of the upstream connector; and a second gasket located between the first and second seats, the second gasket being resiliently compressed between the first and second seats to form a seal between the second upstream connector and the second downstream connector, one of the second upstream and second downstream connectors having a second cylindrical portion at least partially inserted into another one of the second upstream and second downstream connectors, and at least one second post projecting radially from the second cylindrical portion, and the other one of the second upstream and second downstream connectors having at least one second arcuate slot defined therein, the at least one second arcuate slot being shaped and structured to receive the at least one second post of the one of the second upstream and second downstream connectors.

15. The spray gun assembly of claim 14, further including the second accessory, and wherein the second adapter connects the second end portion of the first accessory to the second accessory.

16. The spray gun assembly of claim 15, further comprising a cap disposed between one of the first and second accessories and one of the first and second adapters.

* * * * *